US006790468B1

(12) United States Patent
Mize, Jr. et al.

(10) Patent No.: US 6,790,468 B1
(45) Date of Patent: Sep. 14, 2004

(54) PATCH BAG AND PROCESS OF MAKING SAME

(75) Inventors: James A. Mize, Jr., Simponville, SC (US); Timothy T. Oberle, Greenville, SC (US)

(73) Assignee: Cryovac, Inc., Duncan, SC (US)

( * ) Notice: Subject to any disclaimer, the term of this patent is extended or adjusted under 35 U.S.C. 154(b) by 0 days.

(21) Appl. No.: 08/941,602

(22) Filed: Sep. 30, 1997

(51) Int. Cl.[7] ..... B31B 1/90

(52) U.S. Cl. ..... 426/129; 428/34.9; 428/36.7; 428/349

(58) Field of Search ..... 426/129; 428/34.9, 428/36.7, 349

(56) References Cited

U.S. PATENT DOCUMENTS

| | | | | |
|---|---|---|---|---|
| 3,383,746 | A | 5/1968 | Narduzi et al. | |
| 3,454,441 | A | 7/1969 | Spruyt | 156/244 |
| 3,552,090 | A | 1/1971 | Roberts et al. | 53/71 |
| 3,628,576 | A | 12/1971 | Owen | 141/65 |
| 4,011,798 | A | 3/1977 | Bambara et al. | 93/35 |
| 4,064,296 | A | 12/1977 | Bornstein et al. | 428/35 |
| 4,119,267 | A | 10/1978 | Kydonieus | 229/53 |
| 4,120,716 | A | 10/1978 | Bonet | 156/272 |
| 4,136,205 | A | 1/1979 | Quattlebaum | 426/412 |
| 4,239,111 | A | 12/1980 | Conant et al. | 206/484 |
| 4,267,960 | A | 5/1981 | Lind et al. | |
| 4,278,738 | A | 7/1981 | Brax et al. | 428/515 |
| 4,302,565 | A | 11/1981 | Goeke et al. | 526/88 |
| 4,302,566 | A | 11/1981 | Karol et al. | 526/125 |
| 4,534,984 | A | 8/1985 | Kuehne | 426/412 |

(List continued on next page.)

FOREIGN PATENT DOCUMENTS

| | | | |
|---|---|---|---|
| EP | 0 512 740 | | 4/1992 |
| GB | 654460 | * | 6/1951 |
| GB | 2 057 392 | | 4/1981 |
| GB | 2 291 402 | | 1/1996 |
| WO | WO 90/03414 | | 4/1990 |
| WO | WO 93/03093 | | 2/1993 |
| WO | WO 96/00688 | * | 1/1996 ..... B65D/75/00 |

OTHER PUBLICATIONS

Annual Book of ASTM Standards, "Standard Test Method for Unrestrained Linear Thermal Shrinkage of Plastic film and Sheeting", pp368–371, 1989.

Journal of Polymer Science, "Determination of Branching Distributions in Polyethylene and Ethylene Copolymers", Wild et al., vol. 20, pp 441–455, 1982.

*Primary Examiner*—Sandra M. Nolan
(74) *Attorney, Agent, or Firm*—Rupert B. Hurley, Jr.

(57) ABSTRACT

An L-seal patch bag has an open top, a bottom seal, a seal along a first side edge, and a patch covering a seamless second side edge. The bag is preferably made by adhering, at intervals and across a continuous flat film, a plurality of discrete film patches. Each of the patches covers a centerline running the length of the elongate flat film. The resulting laminated article is then folded along its length, preferably at the centerline, making a first seal by sealing the elongate flat film to itself by sealing along a first (open, non-seamless) side edge of the elongate flat film. A second seal is then made by sealing across an entirety of the folded, laminated article, which is thereafter cut across below the second seal, whereby an L-seal patch bag is produced. Analogous processes can be used to produce a side-seal patch bag or a backseamed patch bag. Still another process of making a side-seal patch bag involves folding the elongate flat film transversely before sealing along the side edges and cutting the resulting side-seal bag from the remainder of the elongate flat film.

28 Claims, 7 Drawing Sheets

U.S. PATENT DOCUMENTS

| | | | | | |
|---|---|---|---|---|---|
| 4,539,236 | A | | 9/1985 | Vilutis | 428/35 |
| 4,619,361 | A | | 10/1986 | Thomas, Jr. | 206/204 |
| 4,755,403 | A | | 7/1988 | Ferguson | 428/35 |
| 4,879,430 | A | | 11/1989 | Hoffman | 428/35.1 |
| 5,206,075 | A | | 4/1993 | Hodgson, Jr. | 428/216 |
| 5,241,031 | A | | 8/1993 | Mehta | 526/348.1 |
| 5,272,236 | A | | 12/1993 | Lai et al. | 526/348.5 |
| 5,278,272 | A | | 1/1994 | Lai et al. | 526/348.5 |
| 5,302,402 | A | | 4/1994 | Dudenhoeffer et al. | 426/129 |
| RE35,285 | E | | 6/1996 | Quacquarella et al. | 428/34.9 |
| 5,540,646 | A | * | 7/1996 | Williams et al. | 493/210 |
| 5,545,419 | A | | 8/1996 | Brady et al. | 426/129 |
| 5,562,958 | A | | 10/1996 | Walton et al. | 428/34.9 |
| 5,677,383 | A | | 10/1997 | Chum et al. | 525/240 |
| 5,846,620 | A | * | 12/1998 | Compton | 428/35.7 |

* cited by examiner

PATCH BAG AND PROCESS OF MAKING SAME

FIELD OF THE INVENTION

The present invention relates to the packaging of products in bags made from a puncture-resistant flexible film. More particularly, the present invention relates to a patch bag, as well as processes of making patch bags.

BACKGROUND OF THE INVENTION

Patch bags are known for the packaging of bone-in meat products, such as whole bone-in pork loins, etc. The patch reduces the likelihood of film puncture from protruding bones. Many of the patch bags which have been in commercial use for some time have two patches, i.e., one on each side of the lay-flat bag. In this manner, coverage is enhanced over a single patch which covers only one side of the bag, as the two-patch embodiment provides patch coverage on more than just one side of the bag.

However, providing patch coverage on both lay-flat sides of the bag has generally required adhering separate patches on each side of a lay-flat tubing. The adhesion of a patch to each side of the bag has involved a complex series of steps: (a) at intervals, adhering a first set of patches to a first side of a lay-flat tubing film; (b) winding up the resulting laminated article; (c) unwinding the laminated article; and, at the same regular intervals, (d) adhering a second set of patches to the other side of the tubing preferably while taking care to ensure that the second set of patches is aligned with the first set of patches. In this manner, a bag having patches on both lay-flat sides is prepared.

It would be desirable to provide a patch bag having patch coverage on both lay-flat sides, without having to apply separate patches in the relatively complex manner described above. It would also be desirable to provide a patch bag having one patch which extends to cover more than 50 percent of the distance around the bag, while covering a side-edge or bottom-edge of the bag.

SUMMARY OF THE INVENTION

The present invention is directed to a patch bag, and processes of making patch bags, which provide a single patch covering at least a portion (preferably more than 50% across the width) of each of the lay-flat sides of the bag, while avoiding having to apply two separate patches. Moreover, the patch covers a side-edge and/or bottom-edge of the bag. In this manner, coverage can be provided on two different sides of the bag, without having to apply a plurality of patches to the bag film in the making of a single patch bag. This, in turn, avoids the need to register the position of patches so that they are aligned with each other.

As a first aspect, the present invention is directed to a patch bag, comprising a bag having an open top, a bottom seal, and a side-seal at a first side edge of the bag, and a patch which covers a seamless (i.e., folded, unsealed) second side edge of the bag and at least a portion of both a first lay-flat side of the bag and a second lay-flat side of the bag. Preferably, the bag comprises a heat-shrinkable film and the patch comprises a heat-shrinkable film. Preferably, the patch is adhered to an outside surface of the bag.

Preferably, the patch has a width of from about 20 to 200 percent, based on the width of the bag, more preferably, from about 55 to 200 percent; still more preferably, from about 60 to 190 percent.

Preferably, the bag comprises a first biaxially-oriented, heat-shrinkable film comprising an outside abuse layer, a core $O_2$-barrier layer, and an inside-sealant layer. Preferably, the outside abuse layer of the first film comprises at least one member selected from the group consisting of ethylene/alpha-olefin copolymer having a density of from about 0.85 to 0.95 g/cc, propylene/ethylene copolymer, polyamide, ethylene/vinyl acetate copolymer, ethylene/methyl acrylate copolymer, and ethylene/butyl acrylate copolymer. Preferably, the core $O_2$-barrier layer of the first film comprises at least one member selected from the group consisting of ethylene/vinyl alcohol copolymer, polyvinyl chloride, polyvinylidene chloride, polyamide, polyester, and polyacrylonitrile. Preferably, the inside-sealant layer of the first film comprises at least one member selected from the group consisting of thermoplastic polyolefin, thermoplastic polyamide, thermoplastic polyester, and thermoplastic polyvinyl chloride.

Preferably, the patch comprises a second biaxially-oriented, heat-shrinkable film. Preferably, the second biaxially-oriented, heat-shrinkable film comprises at least one member selected from the group consisting of ethylene/alpha-olefin copolymer having a density of from about 0.85 to 0.95 g/cc, propylene/ethylene copolymer, polyamide, ethylene/vinyl acetate copolymer, ethylene/methyl acrylate copolymer, and ethylene/butyl acrylate copolymer.

Preferably, the bag comprises a first film and the patch comprises a second film, the side-seal is through the first film but not through the second film, and the end-seal is through the first film but not through the second film. Preferably, the first film has a thickness of from about 1.5 to 5 mils, and comprises an $O_2$-barrier layer and a layer comprising ethylene/alpha-olefin copolymer having a density of from about 0.85 to 0.95 g/cc. Preferably, the second film has a thickness of from about 2 to 8 mils, and comprises ethylene/alpha-olefin copolymer having a density of from about 0.85 to 0.95 g/cc.

As a second aspect, the present invention pertains to a process of making a patch bag, comprising: (A) adhering a patch film to an elongate flat film having a first side edge and a second side edge, whereby a laminated film article is produced; (B) folding the laminated film article along its length, Whereby a folded, laminated article is formed which has a seamless folded side edge along a fold line thereof; (C) making a first seal by sealing the folded, laminated article to itself, the first seal being along a length of the folded, laminated article, the first seal being spaced from the folded side edge of the folded, laminated article; (D) making a second seal by sealing the folded, laminated article to itself by sealing across the folded, laminated article, whereby a sealed laminated article is formed; and (E) cutting across and through the sealed laminated article below the second seal, whereby an L-seal patch bag is produced. Preferably, the patch is adhered to an outside surface of a bag formed from the sealing of the elongate flat film to itself. Preferably, the patch has a width of from about 20 to 200 percent, based on the width of the L-seal patch bag.

Preferably, the elongate flat film has a substantially uniform width, and the folding is carried out at a centerline running a length of the elongate flat film, so that the first side edge of the elongate flat film and the second side edge of the elongate flat film are placed next to one another, whereby a folded, laminated article is formed which has a seamless folded edge formed along the centerline of the elongate flat film. Preferably, the elongate flat film is prepared by slitting a tubing along its length whereby a slit tubing is produced, followed by opening the slit tubing up to produce the elongate flat film.

Preferably, a plurality of discrete film patches are adhered to the elongate flat film, the film patches being adhered across the elongate flat film at intervals to form the laminated film article, the patches covering intervals of a seamless folded edge of the elongate flat film.

The bag and the patch film composition and characteristics are preferably as set forth according to the first aspect of the present invention.

As a third aspect, the present invention pertains to a process of making a patch bag, comprising: (A) adhering a patch film to an elongate flat film having a first side edge and a second side edge, Whereby a laminated film article is produced; (B) folding the laminated film article along its length, whereby a folded, laminated article is formed which has a seamless folded edge along a fold line thereof, (C) sealing the folded, laminated article to itself by making a plurality of side-seals across the folded, laminated article; (D) cutting across the folded, laminated film outward of the side-seals, whereby a side-seal patch bag is produced. The folding, sealing, and cutting are carried out so that the patch film covers a seamless bottom edge of the side-seal patch bag.

Preferably, the flat film has a substantially uniform width. Preferably, the folding is carried out at a centerline running a length of the elongate flat film, so that the first side edge of the elongate flat film and the second side edge of the elongate flat film are placed next to one another. Preferably, the seamless folded edge is covered by the patch.

Preferably, a plurality of discrete film patches are adhered to the elongate flat film, the film patches being adhered across the elongate flat film at intervals relative to one another to form the laminated film article. Preferably, each of the patches covers the centerline running a length of the elongate flat film. Preferably, the elongate flat film is prepared by slitting a tubing along its length whereby a slit tubing is produced, followed by opening the slit tubing up to result in the elongate flat film Preferably, the patch has a length of from about 20 to 200 percent, based on the length of the patch bag; more preferably, from about 20 to 180 percent. Preferably, the elongate flat film comprises a first biaxially-oriented, heat-shrinkable film comprising an outside abuse layer, a core $O_2$-barrier layer, and an inside-sealant layer, and the patch comprises a second biaxially-oriented, heat-shrinkable film. Preferably, the bag and the patch film composition and characteristics are preferably as set forth according to the first aspect of the present invention.

According to an alternative preferred embodiment of the third aspect of the present invention, the elongate flat film has a substantially uniform width, and the folding is carried out along a line parallel to a machine direction of the elongate flat film, but offset from a centerline by a distance of from about 0.1 inch to 2 inches, Whereby a folded, laminated article is formed, the folded, laminated article having a seamless folded edge on a first side edge thereof, and offset lips on a second side edge thereof Preferably, the process further comprises puncturing a protruding offset lip, so that a hole is formed in the protruding offset lip.

As a fourth aspect, the present invention pertains to a patch bag, comprising: (A) a bag having an open top, a bottom seal, a first lay-flat side, a second lay-flat side, a seamless first side edge, and a seamless second side edge; (B) a patch covering: (i) across an entirety of a width of the first lay-flat side of the bag, (ii) the seamless first side edge; and (ii) the seamless second side edge; and (C) a backseamed seal in the second lay-flat side of the bag, the backseamed seal running a length of the bag.

As a fifth aspect, the present invention pertains to a process of making a patch bag, comprising: (A) adhering a patch film to an elongate flat film having a first side edge and a second side edge, whereby a laminated film article is produced, (B) folding the laminated film article at two separate folds along its length, so that a folded, laminated article is formed which has a first lay-flat side, two seamless side edges, and a second lay-flat side containing two overlapping film regions; (C) making a first seal by sealing the overlapping film regions to one another along the length of the folded, laminated article; (D) making a second seal by sealing the folded, laminated article to itself by sealing across an entirety of the folded, laminated article, whereby a sealed laminated article is formed; and (E) cutting across and through the sealed laminated article below the second seal, whereby a backseamed patch bag is produced.

As a sixth aspect, the present invention pertains to a patch bag, comprising: (A) a bag having an open top, a first side-seal, a second side-seal, and a seamless bottom edge; and (B) a single patch which covers the seamless bottom edge of the bag, at least a portion of an outside surface of a first lay-flat side of the bag, and at least a portion of an outside surface of a second lay-flat side of the bag, the single patch having a length of from about 101 to 200 percent of a length of the bag. Preferably, the single patch has a length of from about 105 to 200 percent of the length of the bag; more preferably, from about 110 to 200 percent; still more preferably, from about 110 to 180 percent; yet still more preferably, from about 110 to 170 percent.

As a seventh aspect, the present invention pertains to a process of making a patch bag, comprising: (A) adhering a patch film to an elongate flat film which has a first side edge and a second side edge, whereby a laminated film article is produced; (B) folding the laminated film article transverse to its length, the folding being in a region of the laminated film article in which the patch film is adhered to the elongate flat film, whereby a folded, laminated article is formed which has a seamless folded transverse bottom edge; (C) sealing the folded, laminated article to itself by making a first seal along the first side edge and a second seal along the second side edge, whereby the elongated flat film becomes a sealed article; and (D) cutting across and through the laminated film article at a location above the bottom edge, whereby a side-seal patch bag is produced, and wherein the folding, sealing, and cutting are carried out so that the patch film covers a seamless bottom edge of the folded elongate film, and the patch film is adhered to the outside surface of the sealed article.

DETAILED DESCRIPTION OF THE INVENTION

Figure 1:
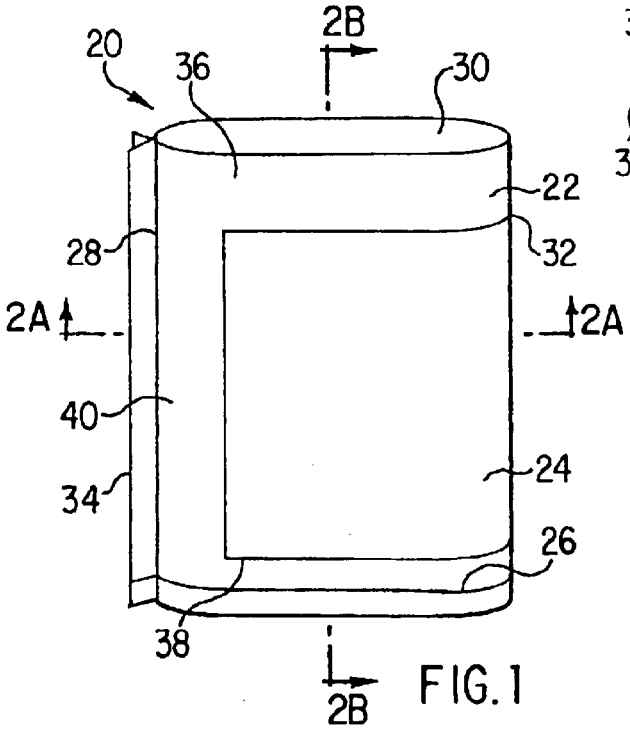
FIG. 1 illustrates a schematic view of a preferred L-seal patch bag according to the present invention, in a lay-flat view.

All of the patch bags and processes set forth herein involve folding and sealing the film from which the bag is made. To this end, the processes preferably rely upon an "elongate flat film" which is supplied continuously from rollstock or from an extruder. Although the elongate flat film is "elongated" in the machine direction, if a very short or narrow bag is being produced, the elongate flat film may actually be wider than it is long. However, in preferred processes and bags according to the present invention, the elongate flat film is provided in a form having a machine direction to transverse direction size ratio of at least 10:1, i.e., a length at least 10 times its width, preferably at least 100 times its width. Preferably the elongate flat film has a substantially uniform width (i.e., plus or minus 5 percent). A particularly preferred method of providing the elongate flat film is to slitting a tubular film along its length, and thereafter opening it up to provide the elongate flat film.

As used herein, the term "bag" is inclusive of L-seal bags, side-seal bags, and pouches. An L-seal bag has an open top, a bottom seal, one side-seal along a first side edge, and a seamless (i.e., folded, unsealed) second side edge. A side-seal bag has a an open top, a seamless bottom edge, with each of its two side edges having a seal therealong. Although seals along the side and/or bottom edges can be at the very edge itself, (i.e., seals of a type commonly referred to as "trim seals"), preferably the seals are spaced inward (preferably ¼ to ½ inch, more or less) from the bag side edges, and preferably are made using a hot bar, impulse-type heat sealing apparatus. A backseamed bag is a bag having an open top, two seamless side edges, and a bottom seal along a bottom edge of the bag. As used herein, a seal referred to as being "along the edge" is a seal which can be at the edge or spaced inwardly from the edge.

As used herein, a phrase such as "below the seal" is used with respect to a process step in which some action, such as cutting, is being carried out on the elongate flat film at a position upstream of the action, i.e., upstream relative to the supply of elongate flat film.

As used herein, the phrase "the width of the bag" refers to the entire width of the patch bag, from one edge to the other. A distance of 200% of the width of the bag is the full distance around the patch bag. Thus, maximum width of that portion of a single patch adhered to a bag is 200% of the width of the bag. of a single patch is Likewise, the phrase "the length of the bag" refers to the entire length of the bag, from the open top of the bag to the bottom edge of the bag. A distance of 200% of the length of the bag is the distance from the top edge of one lay-flat side of the bag down to the bottom edge of the bag, and back up to the top edge of the other lay-flat side of the bag. Thus, the maximum width of a single patch adhered to an L-seal or backseamed bag is 200% of the width of the bag. The maximum length of a single patch adhered to a side-seal bag is 200% of the length of the bag.

As used herein, the phrase "uncovered portion of the bag" refers to a portion of the bag which is not covered by a patch, i.e., a portion of the bag having both its inside surface and its outside surface not adhered to, or otherwise covered by, one or more patches.

The bag "edge," or "side edge," or "sideline," or "bottom edge," or "bottomline," can be either by a mere "fold" in the bag, a trim seal, or a cut film edge having a seal inward thereof. Although folded edges need not contain a crease, in reality folded edges are usually creased by processing rollers in the manufacture of the bag. Bag edges, sidelines, and bottomlines are determined by placing an empty bag on a flat supporting surface, with the seals and creased edges flat against the supporting surface, i.e., in lay-flat configuration The perimeter of the bag in its lay-flat configuration determines the edges, sidelines, and bottomline. The opening through which a product can be placed into the bag is herein referred to as the open bag top, and the edge at the end of the bag opposite the top is herein referred to as the bottom edge of the bag. The edges connection the bottom edge with the open top are herein referred to as the side edges of the bag.

As used herein, the term "inward" is used with respect to a bag edge, patch edge, or any seal, and refers to a region of the bag, patch, or patch bag, this region extending from the referenced edge or seal to the center of the patch bag, in lay-flat configuration. Likewise, as used herein, the term "outward" is used with to a bag edge, patch edge, or any seal, and refers to the region of the bag, patch, or patch bag, this region extending from the referenced edge or seal out and away may from the center of the patch bag, inlay-flat configuration. As used herein, the phrase "above the bottom edge" refers to a location on the bag which is between the bottom edge of the bag and that position which could be the upper most position which could be used to form the top edge of the bag.

As used herein, the phrase "edges next to one another" refers to edge alignment, when the patch bag is in its lay-flat position, so that the subject edge is within 1 inch of the other subject edge; preferably, within 0.5 inch, more preferably, within 0.2 inch, and still more preferably, within 0.1 inch As used herein, the term "film" is used in a generic sense to include plastic web, regardless of whether it is film or sheet. As used herein, the phrase "bag film" refers to the film making up the bag portion of the patch bag. As used herein, the phrase "patch film" refers to the film making up the patch portion of the patch bag. Preferably, films of and used in the present invention have a thickness of 0.25 mm or less. As used herein, the term "package" refers to packaging materials used in the packaging of a product.

As used herein, the term "seal" refers to any seal of a first region of a film surface to a second region of a film surface, wherein the seal is formed by heating the regions to at least their respective seal initiation temperatures. The heating can be performed by any one or more of a wide variety of manners, such as using a heated bar, hot air, infrared radiation, ultrasonic sealing, etc. The phrase "seal through the film" refers to the films through which heat must be passed in order to heat the sealing layers to a temperature at which sealing can be effected.

As used herein, the phrases "seal layer", "sealing layer", "heat seal layer", and "sealant layer", refer to an outer film layer, or layers, involved in the sealing of the film to itself, another film layer of the same or another film, and/or another article which is not a film. Up to the outer 3 mils of a film can be involved in impulse-type heat sealing of the film to itself or another layer. With respect to packages made from multilayer film having fin-type seals, as opposed to lap-type seals, the phrase "sealant layer" refers to the inside film layer of a package, as well as supporting layers adjacent this sealant layer. In the packaging of foods this inside-sealant layer frequently also serves as a food-contact layer.

In a lap seal, opposing edges of the same film are overlapped and sealed to one another. A backseam can of the fin-seal type or the lap-seal type. In the backseamed patch bag of the present invention, a backseam is of the lap-seal type makes the transverse seal less encumbered by the thickness differential (i.e., 3× and 2× film thicknesses) than a fin-type backseam (4× and 2× film thicknesses).

A sealant layer to be sealed by heat-sealing can comprise any thermoplastic polymer; preferably, the heat-sealing layer comprises, for example, thermoplastic polyolefin, thermoplastic polyamide, thermoplastic polyester, and thermoplastic polyvinyl chloride; more preferably, thermoplastic polyolefin, still more preferably, thermoplastic polyolefin having less than 60 weight percent crystallinity. Preferred sealant compositions are the same as the compositions for the abuse layer, as set forth below.

As used herein, the term "barrier", and the phrase "barrier layer", as applied to films and/or film layers, is used with reference to the ability of a film or film layer to serve as a barrier to one or more gases. Oxygen (i.e., $O_2$) barrier layers can comprise, for example, ethylene/vinyl alcohol copolymer, polyvinyl chloride, polyvinylidene chloride, polyamide, polyester, polyacrylonitrile, etc., as known to those of skill in the art; preferably, the oxygen barrier layer comprises ethylene/vinyl alcohol copolymer, polyvinyl chloride, polyvinylidene chloride, and polyamide; more preferably, vinylidene chloride/methyl acrylate copolymer, as known to those of skill in the art.

As used herein, the phrase "abuse layer", as well as the phrase "puncture-resistant layer", refer to an outer film layer and/or an inner film layer, so long as the film layer serves to resist abrasion, puncture, and other potential causes of reduction of package integrity, as well as potential causes of reduction of package appearance quality. Abuse layers can comprise any polymer, so long as the polymer contributes to achieving an integrity goal and/or an appearance goal; preferably, abuse layers comprise polymer comprising at least one member selected from the group consisting of ethylene/alpha-olefin copolymer having a density of from about 0.85 to 0.95 g/cc, propylene/ethylene copolymer, polyamide, ethylene/vinyl acetate copolymer, ethylene/methyl acrylate copolymer, and ethylene/butyl acrylate copolymer, etc. as known to those of skill in the art; more preferably, ethylene/vinyl acetate copolymer and ethylene/alpha-olefin copolymer having a density of from about 0.91 to 0.93 g/cc; still more preferably, the abuse layer of the bag film comprises 85–100 weight percent ethylene/vinyl acetate copolymer, and 0–15 weight percent LLDPE, while the still more preferred abuse layer of the patch film comprises 85–100 weight percent LLDPE and 0–15 weight percent ethylene/vinyl acetate copolymer having a vinyl acetate content of about 9 percent.

As used herein, the term "core", and the phrase "core layer", as applied to multiplayer films, refer to any internal film layer which has a primary function other than serving as an adhesive or compatibilizer for adhering two layers to one another. Usually, the core layer or layers provide the multilayer film with a desired level of strength, i.e., modulus, and/or optics, and/or added abuse resistance, and/or specific impermeability.

As used herein, the phrase "tie layer" refers to any internal layer having the primary purpose of adhering two layers to one another. Tie layers can comprise any polymer having a polar group grafted thereon, so that the polymer is capable of covalent bonding to polar polymers such as polyamide and ethylene/vinyl alcohol copolymer; preferably, tie layers comprise at least one member selected from the group consisting of polyolefin, modified polyolefin, ethylene/vinyl acetate copolymer, modified ethylene/vinyl acetate copolymer, and homogeneous ethylene/alpha-olefin copolymer; more preferably, tie layers comprise at least one member selected from the group consisting of anhydride modified grafted linear low density polyethylene, anhydride grafted low density polyethylene, homogeneous ethylene/alpha-olefin copolymer, and anhydride grafted ethylene/vinyl acetate copolymer.

As used herein, the term "lamination", the term "laminate", and the phrase "laminated film", refer to the process, and resulting product, made by bonding together two or more layers of film or other materials. Lamination can be accomplished by joining layers with adhesives, joining with heat and pressure, and even spread coating and extrusion coating. The term laminate is also inclusive of coextruded multilayer films comprising one or more tie layers.

As used herein, the term "oriented" refers to a polymer-containing material which has been stretched at an elevated temperature (the orientation temperature), followed by being "set" in the stretched configuration by cooling the material while substantially retaining the stretched dimensions. Upon subsequently heating unrestrained, unannealed, oriented polymer-containing material to its orientation temperature, heat shrinkage is produced almost to the original unstretched, i.e., pre-oriented dimensions. More particularly, the term "oriented", as used herein, refers to oriented films, wherein the orientation can be produced in one or more of a variety of manners.

As used herein, the phrase "orientation ratio" refers to the multiplication product of the extent to which the plastic film material is expanded in several directions, usually two directions perpendicular to one another. Expansion in the machine direction is herein referred to as "drawing", whereas expansion in the transverse direction is herein referred to as "stretching". For films extruded through an annular die, stretching is obtained by "blowing" the film to produce a bubble. For such films, drawing is obtained by passing the film through two sets of powered nip rolls, with the downstream set having a higher surface speed than the upstream set, with the resulting draw ratio being the surface speed of the downstream set of nip rolls divided by the surface speed of the upstream set of nip rolls. The degree of orientation is also referred to as the orientation ratio, or sometimes as the "racking ratio".

As used herein, the phrases "heat-shrinkable," "heat-shrink" and the like refer to the tendency of a film, generally an oriented film to shrink upon the application of heat, i.e., to contract upon being heated, such that the size (area) of the film decreases while the film is in an unrestrained state decreases. Likewise, the tension of a heat-shrinkable film increases upon the application of heat if the film is restrained from shrinking. As a corollary, the phrase "heat-contracted" refers to a heat-shrinkable film, or a portion thereof, which has been exposed to heat such that the film or portion thereof is in a heat-shrunken state, i.e., reduced in size (unrestrained) or under increased tension (restrained). Preferably, the heat shrinkable film has a total free shrink (i.e., machine direction plus transverse direction), as measured by ASTM D 2732, of at least as 5 percent at 185° C., more preferably at least 7 percent, still more preferably, at least 10 percent, and, yet still more preferably, at least 20 percent.

As used herein, the term "monomer" refers to a relatively simple compound, usually containing carbon and of low molecular weight, which can react to form a polymer by combining with itself or with other similar molecules or compounds.

As used herein, the term "comonomer" refers to a monomer which is copolymerized with at least one different monomer in a copolymerization reaction, the result of which is a copolymer.

As used herein, the term "polymer" refers to the product of a polymerization reaction, and is inclusive of homopolymers, copolymers, terpolymers, etc. The layers of a film can consist essentially of a single polymer, or can have still additional polymers together therewith, i.e., blended therewith.

As used herein, the term "homopolymer" is used with reference to a polymer resulting from the polymerization of a single monomer, i.e., a polymer consisting essentially of a single type of repeating unit.

As used herein, the term "copolymer" refers to polymers formed by the polymerization reaction of at least two different monomers. For example, the term "copolymer" includes the copolymerization reaction product of ethylene and an alpha-olefin, such as 1-hexene. However, the term "copolymer" is also inclusive of for example, the copolymerization of a mixture of ethylene, propylene, 1-hexene, and 1-octene.

As used herein, the term "copolymerization" refers to the simultaneous polymerization of two or more monomers.

As used herein, a copolymer identified in terms of a plurality of monomers, e.g., "propylene/ethylene copolymer", refers to a copolymer in which either monomer may copolymerize in a higher weight or molar percent than the other monomer or monomers. However, the first listed monomer preferably polymerizes in a higher weight percent than the second listed monomer, and, for copolymers which are terpolymers, quadripolymers, etc., preferably the first monomer copolymerizes in a higher weight percent than the second monomer, and the second monomer copolymerizes in a higher weight percent than the third monomer, etc.

As used herein, copolymers are identified, i.e., named, in terms of the monomers from which the copolymers are produced. For example, the phrase "propylene/ethylene copolymer" refers to a copolymer produced by the copolymerization of both propylene and ethylene, with or without additional comonomer(s). A copolymer comprises recurring "mer units,", i.e., "mers," which are units of a polymer, each of which are derived from a monomer used in the polymerization reaction. For example, the phrase "alpha-olefin mer" refers to a unit in, for example, an ethylene/alpha-olefin copolymer, the polymerization unit being that "residue" which is derived from the alpha-olefin monomer after it reacts to become a portion of the polymer chain, i.e., that portion of the polymer contributed by an individual alpha-olefin monomer after it reacts to become a portion of the polymer chain, as it no longer contains the double bond present in the alpha-olefin monomer.

As used herein, terminology employing a "/" with respect to the chemical identity of a copolymer (e.g., "an ethylene/alpha-olefin copolymer"), identifies the comonomers which are copolymerized to produce the copolymer. As used herein, "ethylene alpha-olefin copolymer" is the equivalent of "ethylene/alpha-olefin copolymer."

As used herein, the phrase "heterogeneous polymer" refers to polymerization reaction products of relatively wide variation in molecular weight and relatively wide variation in composition distribution, i.e., typical polymers prepared, for example, using conventional Ziegler-Natta catalysts. Heterogeneous polymers are useful in various layers of the film used in the present invention. Although there are a few exceptions (such as TAFMER™ ethylene/alpha-olefin copolymers produced by Mitsui Petrochemical Corporation), heterogeneous polymers typically contain a relatively wide variety of chain lengths and comonomer percentages.

As used herein, the phrase "heterogeneous catalyst" refers to a catalyst suitable for use in the polymerization of heterogeneous polymers, as defined above. Heterogeneous catalysts are comprised of several kinds of active sites which differ in Lewis acidity and steric environment. Ziegler-Natta catalysts are heterogeneous catalysts. Examples of Ziegler-Natta heterogeneous systems include metal halides activated by an organometallic co-catalyst, such as titanium chloride, optionally containing magnesium chloride, complexed to trialkyl aluminum, as is disclosed in patents such as U.S. Pat. No. 4,302,565, to GOEKE, et. aL, and U.S. Pat. No. 4,302,566, to KAROL, et. al, both of which are hereby incorporated, in their entireties, by reference thereto.

As used herein, the phrase "homogeneous polymer" refers to polymerization reaction products of relatively narrow molecular weight distribution and relatively narrow composition distribution. Homogeneous polymers are useful in various layers of the multilayer film used in the present invention. Homogeneous polymers are structurally different from heterogeneous polymers, in that homogeneous polymers exhibit a relatively event sequencing of comonomers within a chain, a mirroring of sequence distribution in all chains, and a similarity of length of an chains, i.e., a narrower molecular weight distribution. Furthermore, homogeneous polymers are typically prepared using metallocene, or other single-site type catalysis, rather than using Ziegler Natta catalysts.

More particularly, homogeneous ethylene/alpha-olefin copolymers may be characterized by one or more processes known to those of skill in the art, such as molecular weight distribution ($M_w/M_n$), composition distribution breadth index (CDBI), and narrow melting point range and single melt point behavior. The molecular weight distribution ($M_w/M_n$), also known as polydispersity, may be determined by gel permeation chromatography. The homogeneous ethylene/alpha-olefin copolymers useful in this invention generally has ($M_w/M_n$) of less than 2.7; preferably from about 1.9 to 2.5; more preferably, from about 1.9 to 2.3. The composition distribution breadth index (CDBI) of such homogeneous ethylene/alpha-olefin copolymers will generally be greater than about 70 percent. The CDBI is defined as the weight percent of the copolymer molecules having a comonomer content within 50 percent (i.e., plus or minus 50%) of the median total molar comonomer content. The CDBI of linear polyethylene, which does not contain a comonomer, is defined to be 100%. The Composition Distribution Breadth Index (CDBI) is determined via the technique of Temperature Rising Elution Fractionation (TREF). CDBI determination clearly distinguishes the homogeneous copolymers used in the present invention (narrow composition distribution as assessed by CDBI values generally above 70%) from VLDPEs available commercially which generally have a broad composition distribution as assessed by CDBI values generally less than 55%. The CDBI of a copolymer is readily calculated from data obtained from techniques known in the art, such as, for example, temperature rising elution fractionation as described, for example, in Wild et. al., *J. Poly. Sci. Poly. Phys. Ed.,* Vol. 20, p.441 (1982). Preferably, the homogeneous ethylene/alpha-olefin copolymers have a CDBI greater than about 70%, i.e., a CDBI of from about 70% to 99%. In general, the homogeneous ethylene/alpha-olefin copolymers in the multilayer films of the present invention also exhibit a relatively narrow melting point range, in comparison with "heterogeneous copolymers", i.e., polymers having a CDBI of less than 55%. Preferably, the homogeneous ethylene/alpha-olefin copolymers exhibit an essentially singular melting point characteristic, with a peak melting point ($T_m$), as determined by Differential Scanning Colorimetry (DSC), of from about 60° C. to 110° C. Preferably the homogeneous copolymer has a DSC peak $T_m$ of from about 80° C. to 100° C. As used herein, the phrase "essentially single melting point" means that at least about 80%, by weight, of the material corresponds to a single $T_m$ peak at a temperature within the range of from about 60° C. to 110° C., and essentially no substantial fraction of the material has a peak melting point in excess of about 115° C., as determined by DSC analysis. DSC measurements are made on a Perkin Elmer System 7 Thermal Analysis System. Melting information reported are second melting data, i.e., the sample is heated at a programmed rate of 10° C./min, to a temperature below its critical range. The sample is then reheated (2nd melting) at a programmed rate of 10° C./min. The presence of higher melting peaks is detrimental to film properties such as haze, and compromises the chances for meaningful reduction in the seal initiation temperature of the final film.

A homogeneous ethylene/alpha-olefin copolymer can, in general, be prepared by the copolymerization of ethylene and any one or more alpha-olefin. Preferably, the alpha-olefin is a $C_3$–$C_{20}$ alpha-monoolefin, more preferably, a $C_4$–$C_{12}$ alpha-monoolefin, still more preferably, a $C_4$–$C_8$ alpha-monoolefin. Still more preferably, the alpha-olefin comprises at least one member selected from the group consisting of butene-1, hexene-1, and octene-1, i.e., 1-butene, 1-hexene, and 1-octene, respectively. Most preferably, the alpha-olefin comprises octene-1, and/or a blend of hexene-1 and butene-1.

Processes for preparing and using homogeneous polymers are disclosed in U.S. Pat. No. 5,206,075, U.S. Pat. No. 5,241,031, and PCT International Application WO 93/03093, each of which is hereby incorporated by reference thereto, in its entirety. Further details regarding the production and use of homogeneous ethylene/alpha-olefin copolymers are disclosed in PCT International Publication Number WO 90/03414, and PCT International Publication No. WO 93/03093, both of which designate Exxon Chemical Patents, Inc. as the Applicant, and both of which are hereby incorporated by reference thereto, in their respective entireties.

Still another genus of homogeneous ethylene/alpha-olefin copolymers is disclosed in U.S. Pat. No. 5,272,236, to LAI, et. al, and U.S. Pat. No. 5,278,272, to LAI, et. al, both of which are hereby incorporated by reference thereto, in their respective entireties. Each of these patents disclose substantially linear homogeneous long chain branched ethylene/alpha-olefin copolymers produced and marketed by The Dow Chemical Company.

As used herein, the term "polyolefin" refers to any polymerized olefin, which can be linear, branched, cyclic, aliphatic, aromatic, substituted, or unsubstituted. More specifically, included in the term polyolefin are homopolymers of olefin, copolymers of olefin, copolymers of an olefin and an non-olefinic comonomer copolymerizable with the olefin, such as vinyl monomers, modified polymers thereof, and the like. Specific examples include polyethylene homopolymer, polypropylene homopolymer, polybutene, ethylene/alpha-olefin copolymer, propylene/alpha-olefin copolymer, butene/alpha-olefin copolymer, ethylene/vinyl acetate copolymer, ethylene/ethyl acrylate copolymer, ethylene/butyl acrylate copolymer, ethylene/methyl acrylate copolymer, ethylene/acrylic acid copolymer, ethylene/methacrylic acid copolymer, modified polyolefin resin, ionomer resin, polymethylpentene, etc. Modified polyolefin resin is inclusive of modified polymer prepared by copolymerizing the homopolymer of the olefin or copolymer thereof with an unsaturated carboxylic acid, e.g., maleic acid, fumaric acid or the like, or a derivative thereof such as the anhydride, ester or metal salt or the like. It could also be obtained by incorporating into the olefin homopolymer or copolymer, an unsaturated carboxylic acid, e.g., maleic acid, fumaric acid or the like, or a derivative thereof such as the anhydride, ester or metal salt or the like.

As used herein, terms identifying polymer such as "polyamide", "polyester", "polyurethane", etc. are inclusive of not only polymers comprising repeating units derived from monomers known to polymerize to form a polymer of the named type, but are also inclusive of comonomers, derivatives, etc. which can copolymerize with monomers known to polymerize to produce the named polymer. For example, the term "polyamide" encompasses both polymers comprising repeating units derived from monomers, such as caprolactam, which polymerize to form a polyamide, as well as copolymers derived from the copolymerization of caprolactam with a comonomer which when polymerized alone does not result in the formation of a polyamide. Furthermore, terms identifying polymers are also inclusive of mixtures, blends, etc. of such polymers with other polymers of a different type.

As used herein, the phrase "modified polymer", as well as more specific phrases such as "modified ethylene/vinyl acetate copolymer", and "modified polyolefin" refer to such polymers having an anhydride functionality grafted thereon and/or copolymerized therewith and/or blended therewith. Preferably, such modified polymers have the anhydride functionality grafted on or polymerized therewith, as opposed to merely blended therewith. As used herein, the phrase "anhydride-containing polymer" and "anhydride-modified polymer", refer to one or more of the following: (1) polymers obtained by copolymerizing an anhydride-containing monomer with a second, different monomer, and (2) anhydride grafted copolymers, and (3) a mixture of a polymer and an anhydride-containing compound.

As used herein, the phrase "ethylene alpha-olefin copolymer", and "ethylene/alpha-olefin copolymer", refer to such heterogeneous materials as linear low density polyethylene (LLDPE), and very low and ultra low density polyethylene (VLDPE and ULDPE); and homogeneous polymers such as metallocene catalyzed polymers such as EXACT™ resins obtainable from the Exxon Chemical Company, and TAFMER™ resins obtainable from the Mitsui Petrochemical Corporation. All these materials generally include copolymers of ethylene with one or more comonomers selected from $C_4$ to $C_{10}$ alpha-olefin such as butene-1 (i.e., 1-butene), hexene-1, octene-1, etc. in which the molecules of the copolymers comprise long chains with relatively few side chain branches or cross-linked structures. This molecular structure is to be contrasted with conventional low or medium density polyethylenes which are more highly branched than their respective counterparts. The heterogeneous ethylene/alpha-olefin commonly known as LLDPE has a density usually in the range of from about 0.91 per cubic centimeter to about 0.94 grams per cubic centimeter. Other ethylene/alpha-olefin copolymers, such as the long chain branched homogeneous ethylene/alpha-olefin copolymers available from the Dow Chemical Company, known as AFFINITY™ resins, are also included as another type of homogeneous ethylene alpha-olefin copolymer useful in the present invention.

In general, the ethylene/alpha-olefin copolymer comprises a copolymer resulting from the copolymerization of from about 80 to 99 weight percent ethylene and from 1 to 20 weight percent alpha-olefin. Preferably, the ethylene/alpha-olefin copolymer comprises a copolymer resulting from the copolymerization of from about 85 to 95 weight percent ethylene and from 5 to 15 weight percent alpha-olefin.

As used herein, the phrases "inner layer" and "internal layer" refer to any layer, of a multilayer film, having both of its principal surfaces directly adhered to another layer of the film.

As used herein, the phrase "outer layer" refers to any film layer of film having less than two of its principal surfaces directly adhered to another layer of the film. The phrase is inclusive of monolayer and multilayer films. In multilayer films, there are two outer layers, each of which has a principal surface adhered to only one other layer of the multilayer film. In monolayer films, there is only one layer, which, of course, is an outer layer in that neither of its two principal surfaces are adhered to another layer of the film.

As used herein, the phrase "inside layer" refers to the outer layer, of a multilayer film packaging a product, which is closest to the product, relative to the other layers of the multilayer film.

As used herein, the phrase "outside layer" refers to the outer layer, of a multilayer film packaging a product, which is furthest from the product relative to the other layers of the multilayer film. Likewise, the "outside surface" of a bag is the surface away from the product being packaged within the bag.

As used herein, the term "adhered" is inclusive of films which are directly adhered to one another using a heat seal or other means, as well as films which are adhered to one another using an adhesive which is between the two films.

As used herein, the phrase "directly adhered", as applied to film layers, is defined as adhesion of the subject film layer to the object film layer, without a tie layer, adhesive, or other layer therebetween. In contrast, as used herein, the word "between", as applied to a film layer expressed as being between two other specified layers, includes both direct adherence of the subject layer between to the two other layers it is between, as well as including a lack of direct adherence to either or both of the two other layers the subject layer is between, i.e., one or more additional layers can be imposed between the subject layer and one or more of the layers the subject layer is between.

As used herein, the phrase "machine direction", herein abbreviated "MD", refers to a direction "along the length" of the film, i.e., in the direction of the film as the film is formed during extrusion and/or coating.

As used herein, the phrase "transverse direction", herein abbreviated "TD", refers to a direction across the film, perpendicular to the machine or longitudinal direction.

Although the films used in the patch bag according to the present invention can be monolayer films or multilayer films, the patch bag comprises at least two films laminated together. Preferably, the patch bag is comprised of films which together comprise a total of from 2 to 20 layers; more preferably, from 2 to 12 layers; and still more preferably, from 4 to 9 layers. In general, the multilayer film(s) used in the present invention can have any total thickness desired, so long as the film provides the desired properties for the particular packaging operation in which the film is used, e.g. abuse-resistance (especially puncture-resistance), modulus, seal strength, optics, etc.

Figure 2A:
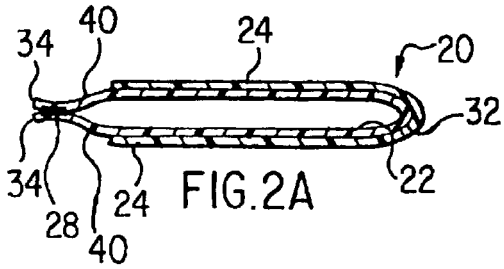
FIG. 2A illustrates a cross-sectional view of the L-seal patch bag illustrated in FIG. 1, taken through section 2A—2A of FIG. 1.
Figure 2B:
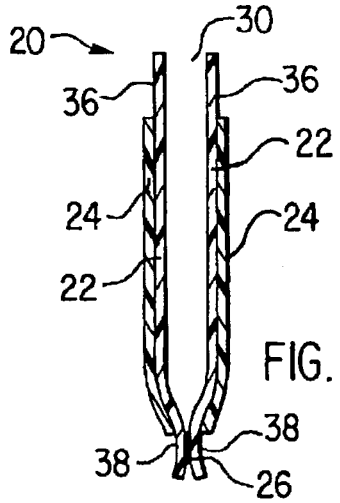
FIG. 2B illustrates cross-sectional view of the L-seal patch bag illustrated in FIG. 1, taken through section 2B—2B of FIG. 1.

FIG. 1 is a lay-flat view of a preferred L-seal patch bag 20, in a lay-flat position, this patch bag being in accordance with the present invention. FIG. 2A is a transverse cross-sectional view of patch bag 20, taken through section 2A—2A of FIG. 1; and, FIG. 2B is a longitudinal cross-sectional view of patch bag 20 taken through section 2B—2B of FIG. 1. Viewing FIGS. 1, 2A, and 2B together, patch bag 20 comprises bag 22 and patch 24. Patch bag 20 has bottom-seal 26, side-seal 28, open top 30, seamless bag side edge 32, and seamed bag side edge 34.

That portion of bag 22 to which patch 24 is adhered is "covered", i.e., protected, by patch 24; for example, patch 24 covers a portion of seamless bag side edge 32. Upper and lower end portions 36 and 38 (respectively) of bag 22, as well as side portion 40 of bag 22, are preferably not covered by patch 24, for ease in producing bottom-seal 26, side-seal 28, both of which are preferably made before a product is placed in the bag, as well as a top-seal (not illustrated) which is preferably made after a product is placed in the bag. Heat sealing through bag 22 and patch 24 requires more heat than heat sealing merely through bag 22. Unless performed properly, sealing through both bag 22 and patch 24 can result in burn through and/or a weaker seal. For a process of sealing through the patch and bag together, see U.S. Ser. No. 60/042,664, now abandoned, in the name of DePoorter et al, entitled "PATCH BAG HAVING SEAL THROUGH PATCHES," filed Apr. 4, 1997, the entirety of which is hereby incorporated by reference thereto. As can be seen in FIG. 2, taken together, patch 24 covers over 50 percent of the distance around bag 22 (i.e., the "transverse circumference" of bag 22).

Figure 3:
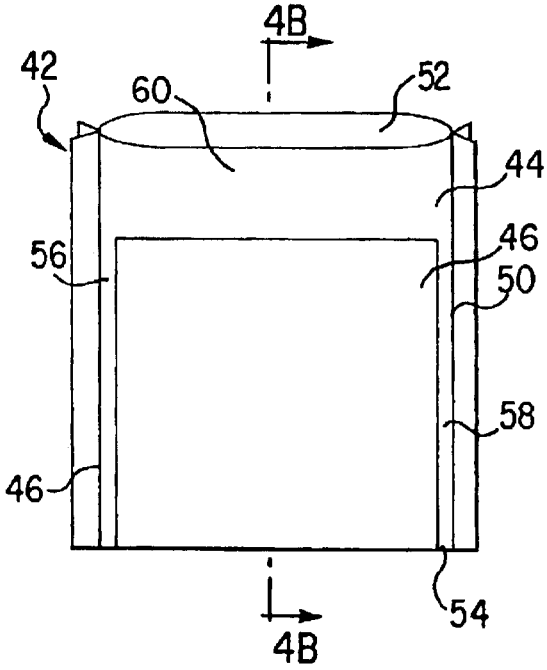
FIG. 3 illustrates a schematic view of a preferred side-seal patch bag made by a process according to the present invention.
Figure 4A:
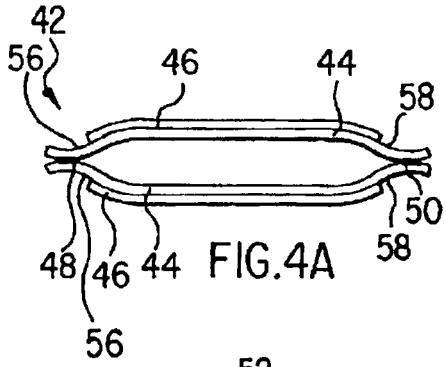
FIG. 4 illustrates a cross-sectional view of the side-seal patch bag illustrated in FIG. 3, taken through section 4—4 of FIG. 3.
Figure 4B:
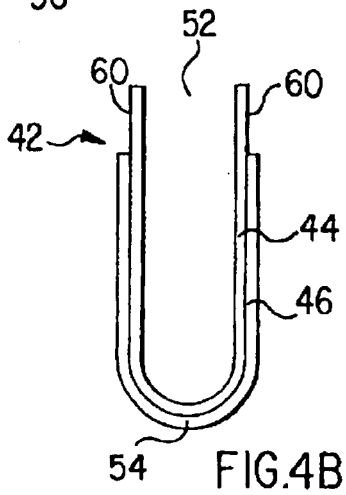

FIGS. 3, 4A, and 4B illustrate various views of side-seal bag 42, which can be produced by a process in accordance with the present invention. Whereas FIG. 3 is a lay-flat view of the side-seal patch bag. FIG. 4A is a transverse cross-sectional view of patch bag 42, taken through section 4A—4A of FIG. 3; FIG. 4B is a longitudinal cross-sectional view of patch bag 42, taken through section 4B—4B of FIG. 3. Viewing FIGS. 3, 4A, and 4B together, patch bag 42 comprises bag 44 and patch 46. Patch bag 42 has first side-seal 48, second side-seal 50, open top 52, and seamless bag bottom-edge 54. Patch 46 covers a portion of seamless bag bottom-edge 54. First and second side-portions 56 and 58 (respectively) of bag 44, as well as top portion 60 of bag 44, are preferably not covered by patch 46, for ease in producing first and second side-seals 48 and 50.

Figure 5:
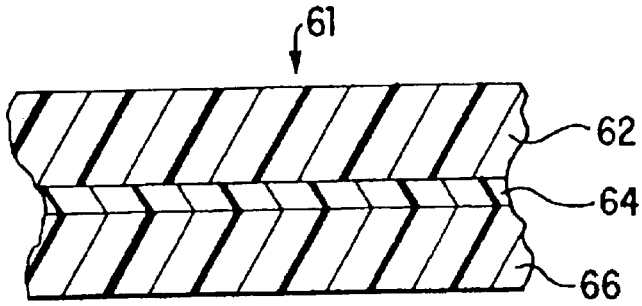
FIG. 5 illustrates a cross-sectional view of a preferred multilayer film suitable for use as the patch in the patch-bags of FIGS. 1 through 4.

FIG. 5 illustrates a cross-sectional view of preferred multilayer film 61 for use as the stock material from which patches 24 and 46 are formed. Preferably, the film stock from which the patches are cut has a total thickness of from about 2 to 8 mils; more preferably, from about 3 to 6 mils. Multilayer film 61 has a physical structure, in terms of number of layers, layer thickness, and layer arrangement and orientation in the patch bag, and a chemical composition in terms of the various polymers, etc. present in each of the layers, as set forth in Table I, below.

TABLE I

| Layer Designation | Layer Function | Chemical Identity | Layer Thickness (mils) |
|---|---|---|---|
| 62 (46) | outside and puncture-resistant | 87% LLDPE #1; 10% EVA #1; 3% antiblock masterbatch #1 | 2.0 |
| 64 (48) | tie layer (self-weld) | EVA #2 | 0.7 |
| 66 (50) | inside and puncture-resistant | 87% LLDPE #1; 10% EVA #1; 3% antiblock masterbatch #1 | 2.0 |

LLDPE #1 was DOWLEX 2045 (TM) linear low density polyethylene, obtained from the Dow Chemical Company of Midland, Mich. EVA #1 was ELVAX 3128 (TM) ethylene/vinyl acetate copolymer having a 9% vinyl acetate content, obtained from E.I. DuPont de Nemours, of Wilmington, Del. EVA #2 was ELVAX 3175 GC (TM) ethylene/vinyl acetate copolymer having a 28% vinyl acetate content, obtained from E.I. DuPont de Nemours, of Wilmington, Del. Antiblock masterbatch #1 was used in either of two different grades. The first grade, a clear masterbatch, was a masterbatch known as 10,075 ACP SYLOID CONCENTRATE (TM) obtained from Technor Apex Co. of Pawtucket, R.I. The second grade, a creme colored masterbatch, was a masterbatch known as EPC 9621C CREAM COLOR SYLOID CONCENTRATE (TM), also obtained from Technor Apex Co. of Pawtucket, R.I. The primary difference between these two masterbatches is that of color, which is both aesthetic as well as potentially functional in that photosensor alignment means for accurate registration of the patches on the bags can utilize the coloration in the patch for detection of the location of the patch. In another preferred embodiment of the patch film for use in the present invention, EVA is removed from each of the outer layers.

Figure 6:
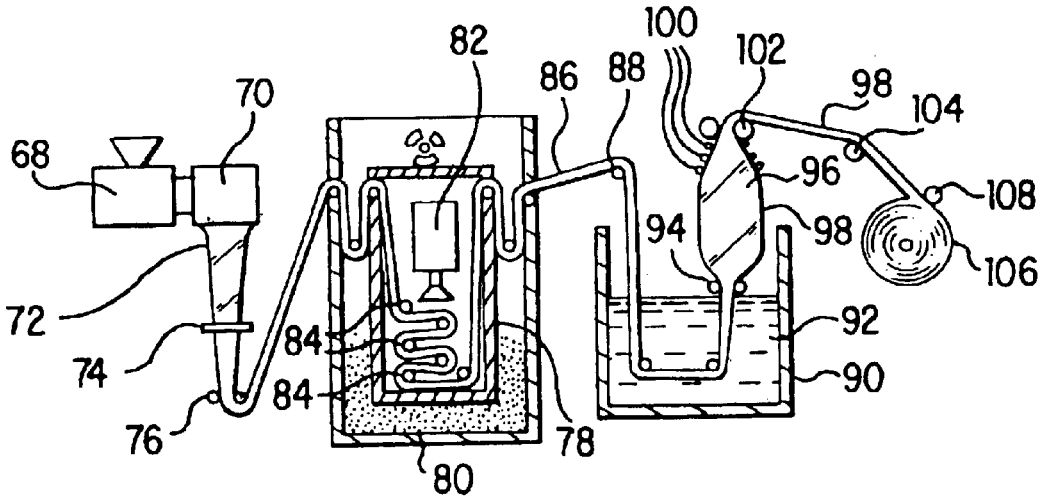
FIG. 6 illustrates a schematic view of a preferred process for making the multilayer film of FIG. 5.

FIG. 6 illustrates a schematic of a preferred process for producing the multilayer film of FIG. 5. In the process illustrated in FIG. 6, solid polymer beads (not illustrated) are fed to a plurality of extruders 68 (for simplicity, only one extruder is illustrated). Inside extruders 68, the polymer beads are forwarded, melted, and degassed, following which the resulting bubble-free melt is forwarded into die head 70, and extruded through annular die, resulting in tubing 72 which is 5–40 mils thick, more preferably 20–30 mils thick, still more preferably, about 25 mils thick.

After cooling or quenching by water spray from cooling ring 74, tubing 72 is collapsed by pinch rolls 76, and is thereafter fed through irradiation vault 78 surrounded by shielding 80, where tubing 72 is irradiated with high energy electrons (i.e., ionizing radiation) from iron core transformer accelerator 82. Tubing 72 is guided through irradiation vault 78 on rolls 84. Preferably, the irradiation of tubing 72 is at a level of about 7 MR.

After irradiation, irradiated tubing 86 is directed over guide roll 88, after which irradiated tubing 86 passes into hot water bath tank 90 containing water 92. The now collapsed irradiated tubing 86 is submersed in the hot water for a retention time of at least about 5 seconds, i.e., for a time period in order to bring the film up to the desired temperature, following which supplemental heating means (not illustrated) including a plurality of steam rolls around which irradiated tubing 86 is partially wound, and optional hot air blowers, elevate the temperature of irradiated tubing 86 to a desired orientation temperature of from about 240° F.–250° F. Thereafter, irradiated film 86 is directed through nip rolls 94, and bubble 96 is blown, thereby transversely stretching irradiated tubing 86. Furthermore, while being blown, i.e., transversely stretched, irradiated film 86 is drawn (i.e., in the longitudinal direction) between nip rolls 94 and nip rolls 102, as nip rolls 102 have a higher surface speed than the surface speed of nip rolls 94. As a result of the transverse stretching and longitudinal drawing, irradiated, biaxially-oriented, blown tubing film 98 is produced, this blown tubing preferably having been both stretched at a ratio of from about 1:1.5–1:6, and drawn at a ratio of from about 1:1.5–1:6. More preferably, the stretching and drawing are each performed at a ratio of from about 1:2–1:4. The result is a biaxial orientation of from about 1:2.25–1:36, more preferably, 1:4–1:16.

While bubble 96 is maintained between pinch rolls 94 and 102, blown tubing 98 is collapsed by rolls 100, and thereafter conveyed through nip rolls 102 and across guide roll 104, and then rolled onto wind-up roll 106. Idler roll 108 assures a good wind-up.

Preferably, the stock film from which the bag is formed has a total thickness of from about 1.5 to 5 mils; more preferably, about 2.5 mils. Preferably the stock film from which the bag is formed is a multilayer film having from 3 to 7 layers; more preferably, 4 layers.

Figure 7:
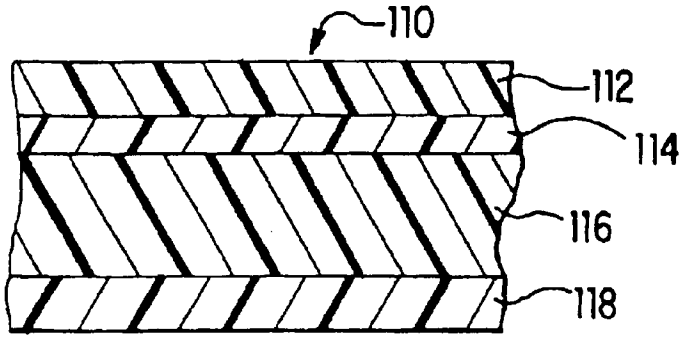
FIG. 7 illustrates a cross-sectional view of a preferred multilayer film suitable for use as the bag in the patch-bags of FIGS. 1 through 4.

FIG. 7 illustrates a cross-sectional view of preferred multilayer film 110 for use as the tubing film stock from which bags 22 and 44 are formed. Multilayer film 110 has a physical structure, in terms of number of layers, layer thickness, and layer arrangement and orientation in the patch bag, and a chemical composition in terms of the various polymers, etc. present in each of the layers, as set forth in Table II, below.

TABLE II

| Layer Designation | Layer Function | Layer Chemical Identity | Layer Thickness (mils) |
|---|---|---|---|
| 112 | outside and abuse layer | EVA #1 | 0.56 |
| 114 | barrier layer | 96% VDC/MA #1, 2% epoxidized soybean oil; and 2% bu-A/MA/bu-MA terpolymer | 0.2 |
| 116 | puncture-resistant | 80% LLDPE #1 & 20% EBA #1 | 1.25 |
| 118 | sealant and inside layer | EVA #1 | 0.33 |

EVA #1 was the same ethylene/vinyl acetate copolymer described above. VDC/MA #1 was SARAN MA-134 (TM) vinylidene chloride/methyl acrylate copolymer, obtained from the Dow Chemical Company. The epoxidized soybean oil was PLAS-CHEK 775 (TM) epoxidized soybean oil, obtained from the Bedford Chemical Division of Ferro Corporation, of Walton Hills, Ohio. Bu-A/MA/bu-MA terpolymer was METABLEN L-1000 (TM) butyl acrylate/methyl methacrylate/butyl methacrylate terpolymer, obtained from Elf Atochem North America, Inc., of 2000 Market Street, Philadelphia, Pa. 19103. EBA #1 was EA 705-009 (TM) ethylene/butyl acrylate copolymer containing 5% butyl acrylate, obtained from the Quantum Chemical Company of Cincinnati, Ohio. Alternatively, EBA #1 can be EA 719-009 (TM) ethylene/butyl acrylate copolymer, having a butyl acrylate content of 18.5%, also obtained from Quantum Chemical Company.

Figure 8:
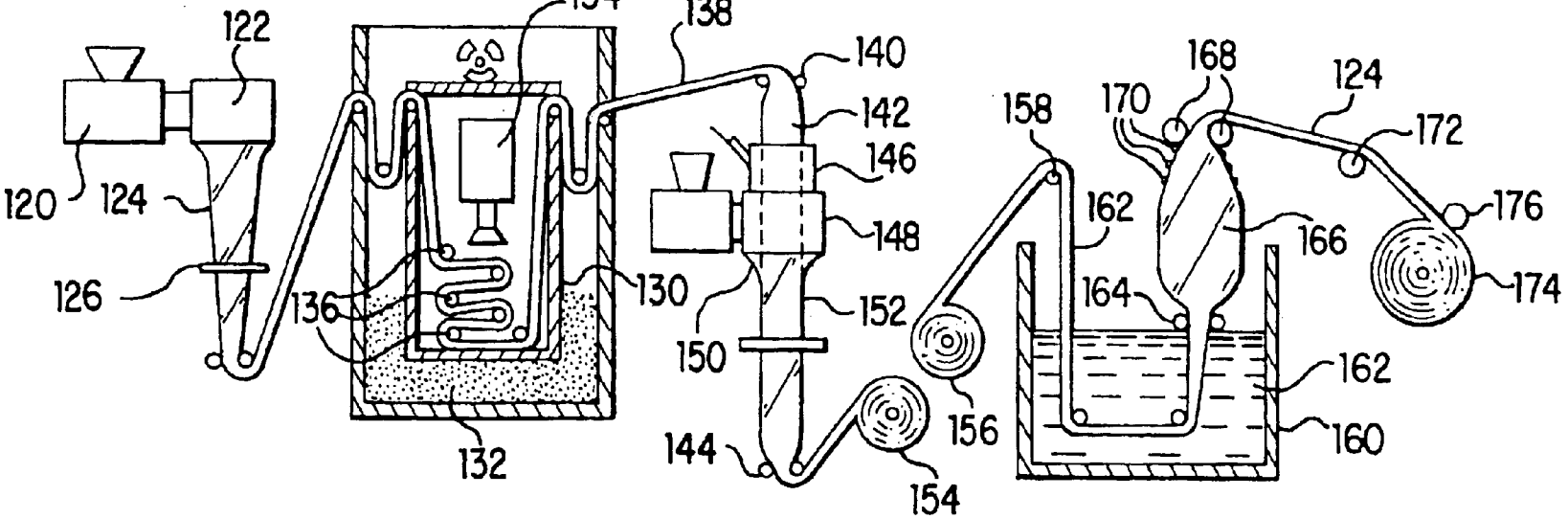
FIG. 8 illustrates a schematic view of a preferred process for making the multilayer film of FIG. 7.

FIG. 8 illustrates a schematic of a preferred process for producing the multilayer film of FIG. 7. In the process illustrated in FIG. 8, solid polymer beads (not illustrated) are fed to a plurality of extruders 120 (for simplicity, only one extruder is illustrated). Inside extruders 120, the polymer beads are forwarded, melted, and degassed, following which the resulting bubble-free melt is forwarded into die head 122, and extruded through an annular die, resulting in tubing 124 which is 10–30 mils thick, more preferably 15–25 mils thick.

After cooling or quenching by water spray from cooling ring 126, tubing 124 is collapsed by pinch rolls 128 (60), and is thereafter fed through irradiation vault 130 surrounded by shielding 132, where tubing 124 is irradiated with high energy electrons (i.e., ionizing radiation) from iron core transformer accelerator 134. Tubing 124 is guided through irradiation vault 130 on rolls 136. Preferably, tubing 124 is irradiated to a level of about 4.5 MR.

After irradiation, irradiated tubing 138 is directed through pinch rolls 140, following which tubing 138 is slightly inflated, resulting in trapped bubble 142. However, at trapped bubble 142, the tubing is not significantly drawn longitudinally, as the surface speed of nip rolls 144 are about the same speed as nip rolls 140. Furthermore, irradiated tubing 138 is inflated only enough to provide a substantially circular tubing without significant transverse orientation, i.e., without stretching.

Slightly inflated, irradiated tubing 138 is passed through vacuum chamber 146, and thereafter forwarded through coating die 148. Second tubular film 150 is melt extruded from coating die 148 and coated onto slightly inflated, irradiated tube 138, to form two-ply tubular film 152. Second tubular film 150 preferably comprises an $O_2$-barrier layer, which does not pass through the ionizing radiation. Further details of the above-described coating step are generally as set forth in U.S. Pat. No. 4,278,738, to BRAX et. al., which is hereby incorporated by reference thereto, in its entirety.

After irradiation and coating, two-ply tubing film 152 is wound up onto windup roll 154. Thereafter, windup roll 154 is removed and installed as unwind roll 156, on a second stage in the process of making the tubing film as ultimately desired. Two-ply tubular film 152, from unwind roll 156, is unwound and passed over guide roll 158, after which two-ply tubular film 152 passes into hot water bath tank 160 containing hot water 162. The now collapsed, irradiated, coated tubular film 152 is submersed in hot water 162 (having a temperature of about 210° F.) for a retention time of at least about 5 seconds, i.e., for a time period in order to bring the film up to the desired temperature for biaxial orientation. Thereafter, irradiated tubular film 152 is directed through nip rolls 164, and bubble 166 is blown, thereby transversely stretching tubular film 152. Furthermore, while being blown, i.e., transversely stretched, nip rolls 168 draw tubular film 152 in the longitudinal direction, as nip rolls 168 have a surface speed higher than the surface speed of nip rolls 164. As a result of the transverse stretching and longitudinal drawing, irradiated, coated biaxially-oriented blown tubing film 124 is produced, this blown tubing preferably having been both stretched in a ratio of from about 1:1.5–1:6, and drawn in a ratio of from about 1:1.5–1:6. More preferably, the stretching and drawing are each performed a ratio of from about 1:2–1:4. The result is a biaxial orientation of from about 1:2.25–1:36, more preferably, 1:4–1:16. While bubble 166 is maintained between pinch rolls 164 and 168, blown tubing 124 is collapsed by rolls 170, and thereafter conveyed through nip rolls 168 and across guide roll 172, and then rolled onto wind-up roll 174. Idler roll 176 assures a good wind-up.

The polymer components used to fabricate multilayer films according to the present invention may also contain appropriate amounts of other additives normally included in such compositions. These include slip agents such as talc, antioxidants, fillers, dyes, pigments and dyes, radiation stabilizers, antistatic agents, elastomers, and the like additives known to those of skill in the art of packaging films.

The multilayer films used to make the patch bag of the present invention are preferably irradiated to induce crosslinking, as well as corona treated to roughen the surface of the films which are to be adhered to one another. In the irradiation process, the film is subjected to an energetic radiation treatment, such as corona discharge, plasma, flame, ultraviolet, X-ray, gamma ray, beta ray, and high energy electron treatment, which induce cross-linking between molecules of the irradiated material. The irradiation of polymeric films is disclosed in U.S. Pat. No. 4,064,296, to BORNSTEIN, et. al., which is hereby incorporated in its entirety, by reference thereto. BORNSTEIN, et. al. discloses the use of ionizing radiation for crosslinking the polymer present in the film.

Radiation dosages are referred to herein in terms of the radiation unit "RAD", with one million RADS, also known as a megarad, being designated as "MR", or, in terms of the radiation unit kiloGray (kGy), with 10 kiloGray representing 1 MR, as is known to those of skill in the art. A suitable radiation dosage of high energy electrons is in the range of up to about 16–166 kGy, more preferably about 44–139 kGy, and still more preferably, 80–120 kGy. Preferably, irradiation is carried out by an electron accelerator and the dosage level is determined by standard dosimetry processes. Other accelerators such as a van der Graaf or resonating transformer may be used. The radiation is not limited to electrons from an accelerator since any ionizing radiation may be used.

As used herein, the phrases "corona treatment" and "corona discharge treatment" refer to subjecting the surfaces of thermoplastic materials, such as polyolefins, to corona discharge, i.e., the ionization of a gas such as air in close proximity to a film surface, the ionization initiated by a high voltage passed through a nearby electrode, and causing oxidation and other changes to the film surface, such as surface roughness.

Corona treatment of polymeric materials is disclosed in U.S. Pat. No. 4,120,716, to BONET, issued Oct. 17, 1978, herein incorporated in its entirety by reference thereto, discloses improved adherence characteristics of the surface of polyethylene by corona treatment, to oxidize the polyethylene surface. U.S. Pat. No. 4,879,430, to HOFFMAN, also hereby incorporated in its entirety by reference thereto, discloses the use of corona discharge for the treatment of plastic webs for use in meat cook-in packaging, with the corona treatment of the inside surface of the web to increase the adhesion of the meat to the adhesion of the meat to the proteinaceous material. Although corona treatment is a preferred treatment of the multilayer films used to make the patch bag of the present invention, plasma treatment of the film may also be used.

Figure 9:
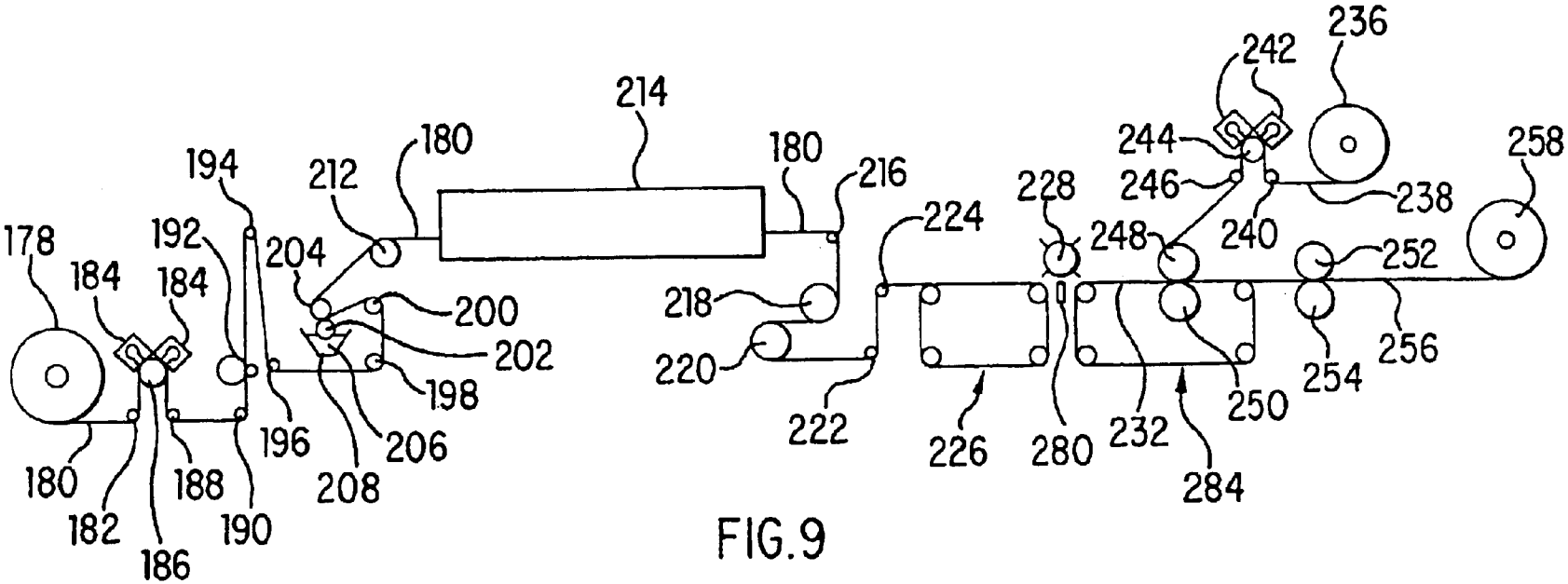
FIG. 9 illustrates a schematic view of a preferred process for making a patch bag.

Patch bags according to the present invention can be made by processes as schematically illustrated in FIGS. 9 and 10. FIG. 9 is a schematic of a preferred portion of a process for making the patch bags as illustrated in FIGS. 1, 4, and 11. In FIG. 9, patch film roll 178 supplies patch film 180. Patch film 180 is directed, by idler roll 182, to corona treatment devices 184 which subject the upper surface of patch film 180 to corona treatment as patch film 180 passes over corona treatment roll 186. After corona treatment, patch film 180 is directed, by idler roll 188 and 190, into (optional) printing roll 192.

Patch film 180 is thereafter directed over idler rolls 194, 196, 198, and 200, after which patch film 180 is passed between a small gap (i.e., a gap wide enough to accommodate patch film 180 passing therethrough while receiving an amount of adhesive which corresponds with a dry coating, i.e., weight after drying, of about 45 milligrams per 10 square inches of patch film) between adhesive application roll 202 and adhesive metering roll 204. Adhesive application roll 202 is partially immersed in adhesive 206 supplied to trough 208. As adhesive roll 202 rotates counterclockwise, adhesive 206, picked up by the immersed surface of adhesive roll 202, moves upward, contacts, and is metered onto, the full width of one side of patch film 180, moving in the same direction as the surface of adhesive roll 202. [Examples of suitable types of adhesives include thermoplastic acrylic emulsions, solvent based adhesives and high solids adhesives, ultraviolet-cured adhesive, and electron-beam cured adhesive, as known to those of skill in the art. A preferred adhesive is a thermoplastic acrylic emulsion known as RHOPLEX N619 (TM) thermoplastic acrylic emulsion, obtained from the Rohm & Haas Company, at Dominion Plaza Suite 545, 17304 Preston Rd., Dallas, Tex. 75252, Rohm & Haas having headquarters at 7th floor, Independence Mall West, Philadelphia, Pa. 19105]. Patch film 180 thereafter passes so far around adhesive metering roll 204 (rotating clockwise) that the adhesive-coated side of patch film 180 is in an orientation wherein the adhesive is on the top surface of patch film 180, as adhesive-coated patch film 180 moves between adhesive metering roll 204 and adhesive metering idler roll 204.

Thereafter, adhesive-coated patch film 180 is directed over drying oven entrance idler roll 212, and passes through oven 214, within which patch film 180 is dried to a degree that adhesive 206 on patch film 180 becomes tacky. Upon exiting oven 214, patch film 180 is directed partially around oven-exit idler roll 216, following which patch film 180 is cooled on chill rolls 218 and 220, each of which has a surface temperature of about 40–45° F., and a diameter of about 12 inches. The cooling of patch film 180 is carried out in order to stabilize patch film 180 from further shrinkage.

Thereafter, patch film 180 is directed, by idler rolls 222 and 224, onto a belt of pre-cutting vacuum conveyor assembly 226, and thereafter forwarded to a rotary scissors-type knife having upper rotary blade assembly 228 and lower blade 230, the knife cutting across the width of patch film 180 in order to form patches 232. Patch 232 are forwarded and held on top of a belt of post-cutting vacuum conveyor assembly 234. While patches 232 are held on the belt of post-cutting vacuum conveyor assembly 234, flat-film supply roll 236 supplies biaxially oriented, lay-flat film 238, which is directed, by idler roll 240, to corona treatment devices 242 which subject the upper surface of lay-flat film 238 to corona treatment as lay-flat film 238 passes over corona treatment roll 244. After corona treatment, lay-flat film 228 is directed, by idler roll 246, partially around the surface of upper pre-lamination nip roll 248, and through the nip between upper prelaminating nip roll 248 and lower prelaminating nip roll 250, the pre-laminating nip rolls being above and below the post-cutting vacuum conveyor belt. Prelaminating roll nips 248 and 250 position patches 232 onto the now lower, corona-treated outside surface of lay-flat film 238. After passing through the nip between prelaminating nip rolls 248 and 250, lay-flat film 238, having patches 232 laminated intermittently thereon, exits off the downstream end of the post-cutting vacuum conveyor assembly 234, and is directed through the nip between upper laminating nip roll 252 and lower laminating nip roll 254, these rolls exerting pressure (about 75 psi) in order to secure patches 232 to lay-flat film 238, to result in flat-film/patch laminate 256, which is wound up to form flat-film/patch laminate roll 258. Patches can be accurately placed and registered on the lay-flat film through the use of photosensors (i.e., photoeyes, etc.).

Thereafter, flat-film/patch laminate 256 is forwarded to a conventional centerfolding apparatus (not illustrated), known to those of skill in the art of film handling and manipulation. The centerfolding apparatus comprises a plate-like support member having an upper surface which the flat-film/patch laminate contacts and passes over. While the upstream end of this plate may have an edge which is perpendicular to the direction of travel of flat-film/patch laminate 256, the downstream end of the plate comes to a "point" (preferably a point not sharp enough to damage flat-film/patch laminate 256) made from the intersection of two edges each of which are of equal length, and which are also each at 45 degrees to the direction of travel of flat-film/patch laminate 256. Flat-film/patch laminate 256, is forwarded over the downstream end of the plate, and wraps around the pointed end and contacts a portion of the underside surface of the plate, i.e., beneath the point of the plate, following which a pair of nip rollers creases a fold down the center of flat-film/patch laminate 256, resulting in a centerfolded film/patch laminate. One or both of these paired nip rolls could be powered, thereby serving to both crease as well as forward centerfolded film/patch laminate. In the centerfolding of the flat-film/patch laminate, the two side edges of the lay-flat film portion are placed parallel to one another an in close proximity to one another, preferably without overlap, so that no portion of the laminate is wasted. Preferably the centerfolding is carried out so that the patches are adhered on the outside surface of the resulting centerfolded film/patch laminate, i.e., so that the patches will be present on the outside surface of the resulting patch bags.

Centerfolded film/patch laminate is then subjected to sealing and cutting by conventional sealing and cutting means. In order to produce the preferred L-seal patch bag illustrated in FIGS. 1, 2A, and 2B, the centerfolded film/patch laminate is heat-sealed along its length, i.e., preferably about 0.5 inches from the pair of aligned side edges of the lay-flat film portion (i.e., the bag film portion) of the centerfolded film/patch laminate, resulting in a backseamed centerfolded film/patch laminate. At approximately the same time, or thereafter, transverse seals are made across the centerfolded film/patch laminate. A transverse cut is also made through the entirety of the centerfolded film/patch laminate, whereby an L-seal bag is formed. Preferably the transverse cut is made parallel to the transverse seal, and about 0.5 inches below the transverse seal, i.e., downstream of the transverse seal. Preferably the transverse cut is made shortly before the transverse seal is made, or after the transverse seal has cooled, so that the tension caused by the cutting apparatus does not pull on that portion of the film which has been heat-softened by the sealing apparatus. If the patches do not extend across the entirety of both sides of the centerfold film/patch laminate, preferably the transverse seal is made through a region of the film/patch laminate which is not covered by a patch, i.e., the transverse seal is made between patches. However, if the patches extend across the entirety of both sides of the centerfolded film/patch laminate, the transverse seals may be made either between patches or through the patch film as well as the bag film. In this manner, the patch can extend not only all of the way around the patch bag, but also to the bottom of the patch bag.

In order to produce the preferred side-seal patch bag illustrated in FIGS. 3 and 4, the centerfolded film/patch laminate is not sealed, but rather only transverse heat seals are made across the centerfolded film/patch laminate. A pair of such transverse seals, with patch material therebetween, is cut free of the centerfolded film/patch laminate with a pair of transverse cuts, one outward of each of the transverse seals. A preferred process makes two transverse heat seals between patches, the heat seals being parallel to one another and preferably about one inch apart. After the seals have cooled to a degree that tension from a cutting apparatus does not damage the film, a transverse cut is made through the centerfolded, sealed film/patch laminate, resulting in the side-seal bag as illustrated in FIGS. 3 and 4. The side edges of the lay-flat film form the open top of the side-seal bag. Since the patch preferably does not extend across the entirety of the width of the lay-flat film, i.e., before centerfolding, the sealing is preferably made through a region of the film/patch laminate which is not covered by a patch, i.e., the seal is made between patches. However, if the patch extends to cover the entire width of the lay-flat film, the seal can be made through the patch film too, thereby providing a patch which covers the entirety of the bag.

It should be noted that the L-seal patch bag according to the present invention has a patch which covers one seamless side edge which is covered by the patch, whereas the side-seal bag made in accordance with the present invention has a seamless bottom edge which is covered by the patch.

Throughout the process described above, patches 232 can have a width less than or equal to the width of lay-flat tubing film 238, so that the patches respectively: (a) leave uncovered regions along the sides of the bag, (b) cover entirely across the width of an L-seal bag (or the entire length of a side-seal bag.

Figure 10A:
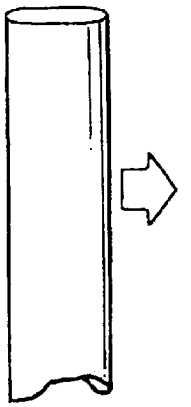
FIGS. 10A, 10B, 10C, 10D, 10E, 10F, 10G, and 10H together illustrate various stages in the processes for making L-seal and end-seal patch bags according to the present invention.
Figure 10B:
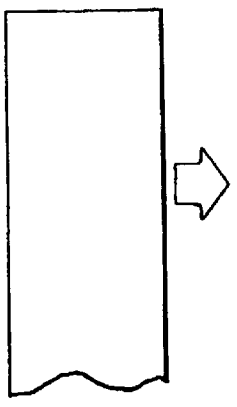
Figure 10C:
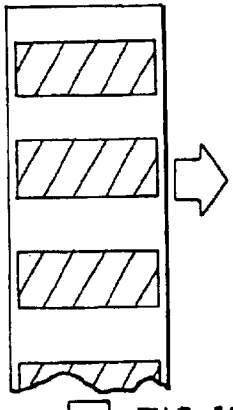
Figure 10D:
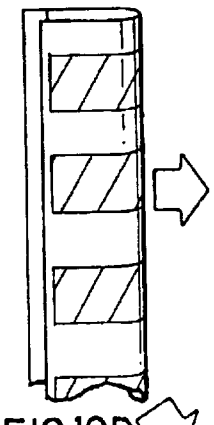
Figure 10E:
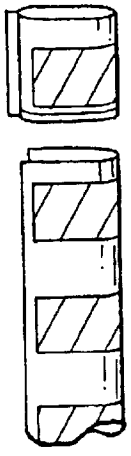
Figure 10H:
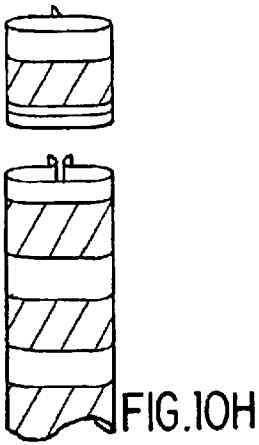
Figure 10G:
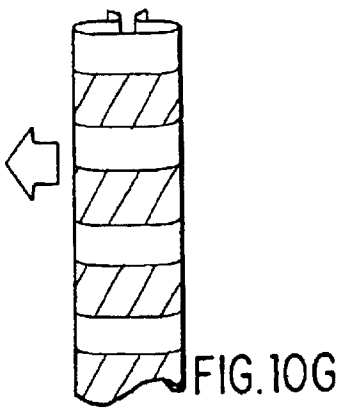
Figure 10F:
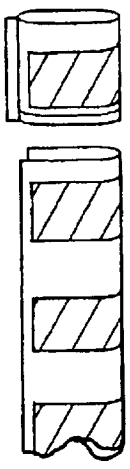
Figure 11:
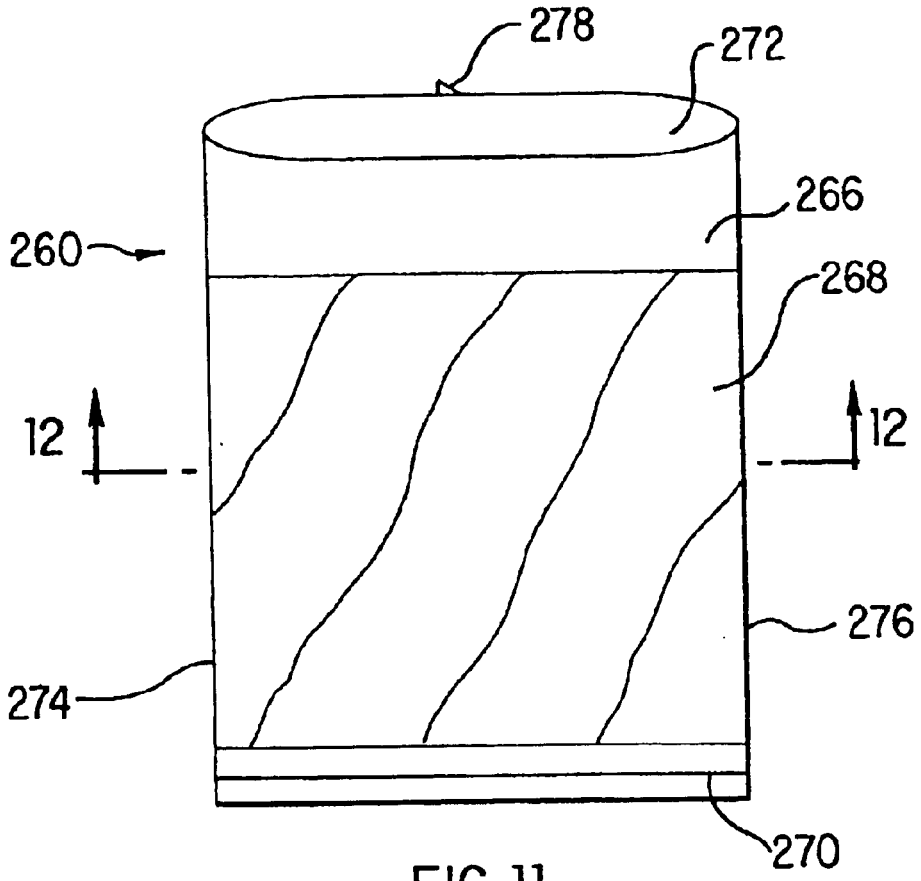
FIG. 11 illustrates a schematic view of a preferred back-seamed patch bag according to the present invention, in a lay-flat view.

FIGS. 10A through 10H illustrate various stages in a process according to the present invention. FIG. 10A illustrates elongated seamless tubing film, which preferably is a heat-shrinkable, multilayer film having an $O_2$-barrier layer. FIG. 10B illustrates a flat film which is formed by slitting the tubing film of FIG. 10A. FIG. 10C illustrates a laminated article formed by adhering, at regular intervals, a plurality of discrete patches across the flat film. FIG. 10D illustrates the laminated article after it has been centerfolded. FIG. 10E illustrates the making of an L-seal patch bag by sealing along a side edge of the folded, laminated article of FIG. 10D, making a transverse seal across the laminated article of FIG. 10D, and cutting through the folded, laminated article below (i.e., downstream of) the transverse seal. In contrast, FIG. 10F illustrates the conversion of the folded, laminated article to a side-seal patch bag by making two transverse seals across the folded, laminated article of FIG. 10D, each of the transverse seals being made at a location outward of the patch, and cutting laminate cutting across and through the folded, laminated article below (i.e., downstream of the lower transverse seal.

Figure 12:
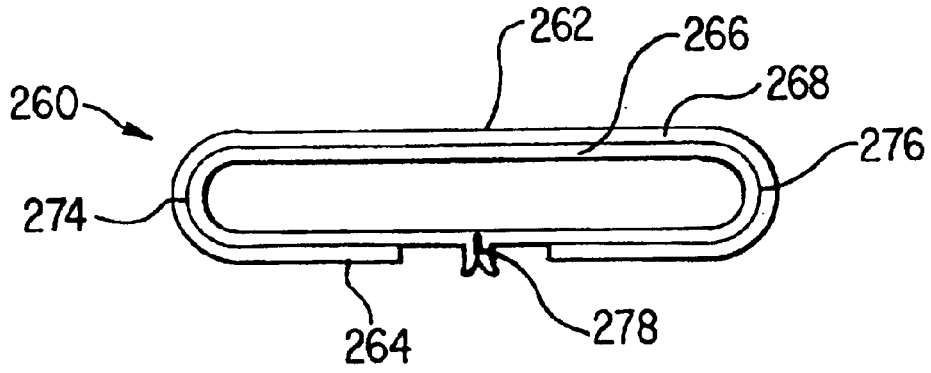
FIG. 12 illustrates a cross-sectional view of the back-seamed patch bag illustrated in FIG. 11, taken through section 12—12 of FIG. 11.

FIGS. 11 and 12 illustrates a "backseamed patch bag" 260 according to the present invention. FIG. 11 is a lay-flat view, while FIG. 12 is a transverse cross-sectional view illustrating both first lay-flat side 262 and second lay-flat side 264 of patch bag 260. Backseamed patch bag 260 further comprises bag 266, patch 268, bottom-seal 270, open top 272, seamless first side edge 274, seamless second side edge 276, and fin-seal type backseam 278, in which the same side of the film (i.e., the film from which bag 266 is made) is sealed to itself. Alternatively, the backseam could be a lap-seal type backseam (not illustrated), in which opposite outer surfaces of the bag film are sealed to one another. Because transverse bottom seal 270 must be made through the film making up the fin formed by the backseam, transverse sealing will be necessity be slower, and will require more pressure, than for the L-seal patch bag of FIG. 1 and the end-seal patch bag of FIG. 3.

The backseamed patch bag of FIGS. 11 and 12 can be made according to a process schematically illustrated in FIGS. 10A through 10C, followed by 10G and 10H. More particularly, the laminated article of FIG. 10C is produced as described above, following which two parallel lengthwise folds are made to produce the folded laminated article of FIG. 10G, which is thereafter backseamed (by otherwise conventional backseaming apparatus and process known to those of skill in the art), and thereafter transverse sealed (downstream of the patch) and transversely cut therethrough, resulting in the background patch bag of FIGS. 10H, 11, and 12.

FIGS. 13A, 13B, 13C, and 13D together illustrate yet another process according to the present invention, which results in a patch bag very similar to the patch bag formed from the process illustrated in FIGS. 10A–10D plus 10F, described above. The difference is that whereas the machine direction of the bag film and the machine direction of the patch film run across the patch bag in FIG. 10F, the machine direction runs the length of the patch film and bag film in the side-seal patch bag produced by the process illustrated in FIGS. 13A through 13D.

Figure 13A:
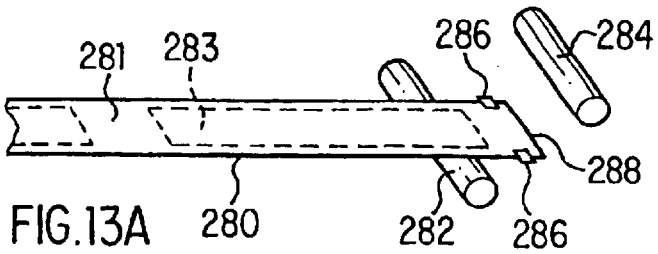
FIGS. 13A, 13B, 13C, and 13D together illustrate various stages of an alternative process according to the present invention, for making a side-seal patch bag according to the present invention.
Figure 13B:
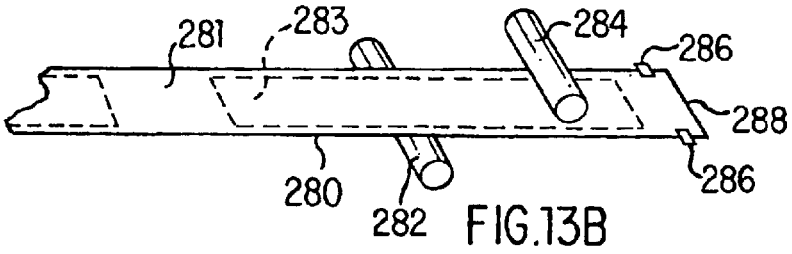
Figure 13C:
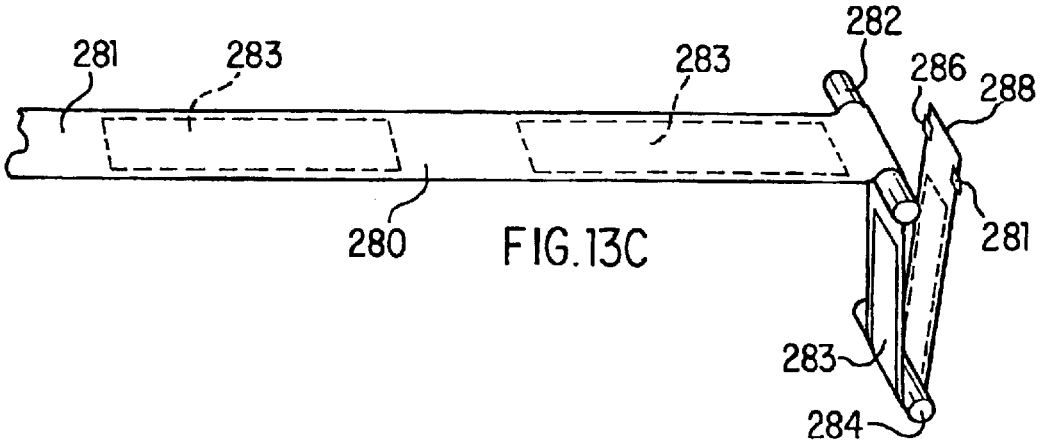
Figure 13D:
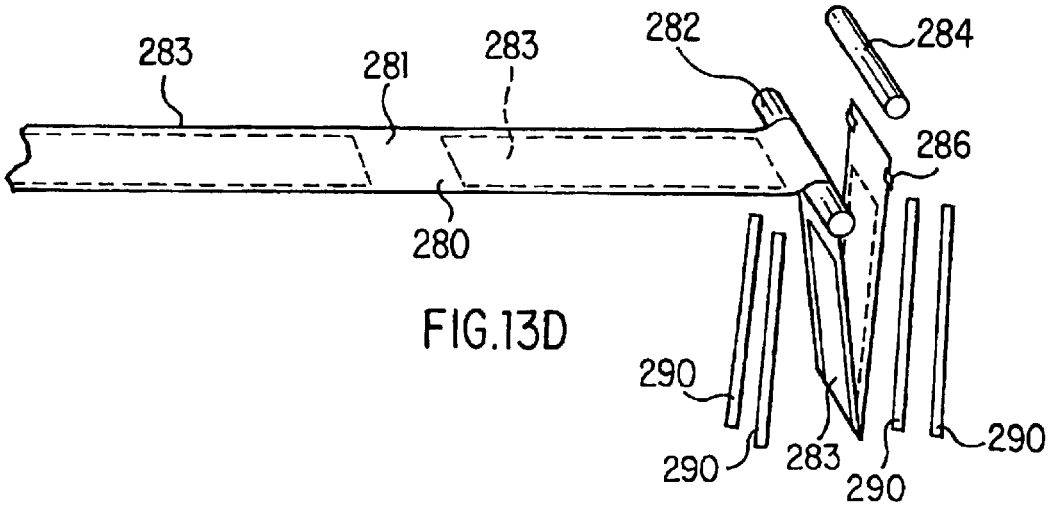

As schematically illustrated in FIGS. 13A, 13B, 13C, and 13D, a side-seal bag is produced by forwarding patch/film laminate 280 (composed of continuous flat film 281 having a plurality of discrete film patches 283, illustrated in dotted lines, adhered to the underside thereof) into the sealing section of the bagmaking machine in an intermittent motion, including over and past first roller 282, to gripper jaw assembly 286, which holds the patch/film laminate near leading edge 288 thereof. As illustrated in FIG. 13B, gripper jaw assembly 286 then moves forward, pulling patch/film laminate 280 horizontally in the machine direction further past and over first roller 282, and past and under second roller 284, which is positioned at an uppermost position in a vertical track. As illustrated in FIG. 13C, second roller 284 is then forced downward by a set of pistons (not illustrated), and gripper jaw assembly 286 moves back toward first roller 282. As second roller 284 moves downward, it continues to pull patch/film laminate 280 over first roller 282, into a sealing section of the machine, i.e., between a set of sealing jaws 290, which are illustrated in an open position in FIG. 13D. When second roller 284 stops at the bottom of its stroke as illustrated in FIG. 13C, it is wrapped by two motionless plies of the patch/film laminate 280. Second roller 284 is then retracted upward to its original position by the pistons, leaving the two plies of films suspended between open set of sealing jaws 290, supported on leading edge 288 by gripper jaw assembly 286, and downstream by first roller 282. The set (of four) sealing jaws (290), aligned in the vertical direction, close and make two seals near the aligned side edges of that portion of patch/film laminate 280 upstream of the first roller 282, thereby forming a sealed, laminated article. As the two side-seals are being made, gripper jaws assembly 286 is opened and the sealed, laminated article is cut free of the remainder of the patch/film laminate 280 by a knife (not illustrated) positioned below first roller 282, resulting in a side-seal bag. When sealing jaw assembly 286 opens, the side-seal bag is removed downward from the sealing head. Gripper jaw assembly 286 then moves backward and grips the new leading edge of the web, which has just been cut away from the now-formed side-seal bag, and the cycle repeats. The side-seal bag appears the same as the patch bag of FIG. 3. The machine direction of both patch film 283 and the bag film 281 runs the length of the patch bag.

Sealing and cutting of tubing to produce bags is disclosed in U.S. Pat. No. 3,552,090, U.S. Pat. No. 3,383,746, and U.S. Ser. No. 844,883, filed Jul. 25, 1969, to OWEN, each of these two U.S. Patents as well as the U.S. Patent application, hereby being incorporated by reference thereto, in their entireties. Heat seal or seals can be made using a hot bar (heat seal) or a nichrome wire fixed to a chilled metal bar (impulse seal), as is known to those of skill in the art, or any other sealing means known to those of skill in the art, such as ultrasonic radiation, radio frequency radiation, and laser. The preferred sealing means is an impulse sealer. Films which are predominantly polyethylene are generally sealed using impulse sealing or hot bar sealing. Both linear and shaped seals can be formed, as is known to those of skill in the art.

Although cutting and sealing can be carried out simultaneously, more preferably, for the patch bag of FIGS. 1, 2A, and 2B, the transverse cutting step is carried out before the transverse heat seal is made. Preferably, a transverse seal is formed between two aligned patches on the continuous tubing, about one-half to three-quarters of an inch downstream of an upstream patch, and several inches from the next downstream patch. The tubing is cut about one-half to three-quarters of an inch downstream of the position at which the seal is made, to result in a bag as illustrated in FIGS. 1, 2, and 3.

One preferred process (and patch bag therefrom) is carried out by adhering a continuous patch film to a continuous flat (i.e., non-tubular) bag film, i.e., in contrast to adhering separate pieces of patch film to the continuous flat film. The resulting laminated article is then centerfolded, cut, and sealed in any of the manners described above. Adhering a continuous patch tubing to a seamless bag tubing is disclosed in copending U.S. Ser. No. 08/579,712, to T. T. Oberle, filed Dec. 28, 1995, entitled "PATCH BAG HAVING CONTINUOUS PATCH".

Although in general the bag according to the present invention can be used in the packaging of any product, the bag of the present invention is especially advantageous for the packaging of food products, especially fresh meat products comprising bone, especially cut bone ends present at or near the surface of the fresh meat product. Preferably, the meat product comprises at least one member selected from the group consisting of poultry, pork, beef, lamb, goat, horse, and fish. More preferably, the meat product comprises at least one member selected from the group consisting of ham, sparerib, picnic, back rib, short loin, short rib, whole turkey, and pork loin. Still more preferably, the meat product comprises bone-in ham, including both smoked and processed ham, fresh bone-in ham, turkey, chicken, and beef shank.

Although the present invention has been described in connection with the preferred embodiments, it is to be understood that modifications and variations may be utilized without departing from the principles and scope of the invention, as those skilled in the art will readily understand. Accordingly, such modifications may be practiced within the scope of the following claims.

What is claimed is:

1. A patch bag comprising a bag and a patch, wherein:

(A) the bag comprises a first heat-shrinkable film, the bag having an open top, a bottom seal, and a side-seal at a first side edge of the bag; and (B) the patch comprises a second heat-shrinkable film, the patch covering a portion of a seamless second side edge of the bag and at least a portion of both a first lay-flat side of the bag and a second lay-flat side of the bag;

wherein the bag comprises a first film and the patch comprises a second film, and the side-seal is through the first film but not through the second film and the patch does not extend to either the bottom seal or the side seal, and the patch covers more than 50 percent across the width of each of the lay-flat sides of the bag.

2. The patch bag according to claim 1, wherein the second film has a total free shrink, at 185° F., of at least 10 percent.

3. The patch bag according to claim 1, wherein the first film is a first biaxially-oriented, heat-shrinkable film comprising an outside abuse layer, a core $0_2$-barrier layer, and an inside-sealant layer, and the second film is a second biaxially-oriented, heat-shrinkable film.

4. The patch bag according to claim 3, wherein:

the outside abuse layer of the first film comprises at least one member selected from the group consisting of ethylene/alpha-olefin copolymer having a density of from about 0.85 to 0.95 g/cc, propylene/ethylene copolymer, polyamide, ethylene/vinyl acetate copolymer, ethylene/methyl acrylate copolymer, and ethylene/butyl acrylate copolymer;

the core $0_2$-barrier layer of the first film comprises at least one member selected from the group consisting of ethylene/vinyl alcohol copolymer, polyvinyl chloride, polyvinylidene chloride, polyamide, polyester, and polyacrylonitrile;

the inside-sealant layer of the first film comprises at least one member selected from the group consisting of thermoplastic polyolefin, thermoplastic polyamide, thermoplastic polyester, and thermoplastic polyvinyl chloride; and the second biaxially-oriented, heat-shrinkable film comprises at least one member selected from the group consisting of ethylene/alpha-olefin copolymer having a density of from about 0.85 to 0.95 g/cc, propylene/ethylene copolymer, polyamide, ethylene/vinyl acetate copolymer, ethylene/methyl acrylate copolymer, and ethylene/butyl acrylate copolymer.

5. The patch bag according to claim 1, wherein the end-seal is through the first film but not through the second film.

6. The patch bag according to claim 1, wherein the patch is adhered to an outside surface of the bag.

7. The patch bag according to claim 1, wherein the patch has a width of from about 20 to 190 percent, based on the width of the bag.

8. A patch bag, comprising:

(A) a lay-flat heat-shrinkable bag having an open top, a bottom seal, a first lay-flat side, a second lay-flat side, a seamless first side edge, and a seamless second side edge;

(B) a heat-shrinkable patch covering:

(i) across an entirety of a width of the first lay-flat side of the bag;

(ii) a portion of the seamless first side edge; and (iii) a portion of the seamless second side edge; and (C) a backseamed seal in the second lay-flat side of the bag, the backseamed seal running the length of the bag, wherein the bag comprises a first film and the patch comprises a second film, and the backseamed seal is through the first film but not through the second film and the patch does not extend to the backseamed seal;

wherein the patch does not cover the bottom of the bag, the patch does not extend to the bottom seal, and the bottom seal is through the bag and not through the patch, and the patch covers more than 50 percent across the width of each of the lay-flat sides of the bag.

9. A patch bag, comprising:

(A) a heat-shrinkable bag having an open top, a first side-seal, a second side-seal, and a seamless bottom edge; and (B) a single heat-shrinkable patch which covers a portion of the seamless bottom edge of the bag, at least a portion of an outside surface of a first lay-flat side of the bag, and at least a portion of an outside surface of a second lay-flat side of the bag, the single patch having a length of from about 101 to 200 percent of a length of the bag, wherein the bag comprises a first film and the patch comprises a second film, and the first and second side seals are through the first film but not through the second film and the patch does not extend to either the first side seal or the second side seal.

10. The patch bag according to claim 1, wherein the patch is adhered to an outside surface of the bag.

11. The patch bag according to claim 1, wherein the first film has a thickness of from about 1.5 to 5 mils, and the second film has a thickness of from about 2 to 8 mils.

12. The patch bag according to claim 11, wherein the second film has a thickness of from about 3 to 6 mils.

13. The patch bag according to claim 1, wherein the bag has only one patch adhered thereto.

14. The patch bag according to claim 8, wherein the bag comprises a first biaxially-oriented, heat-shrinkable film comprising an outside abuse layer, a core $0_2$-barrier layer, and an inside-sealant layer, and the patch comprises a second biaxially-oriented, heat-shrinkable film.

15. The patch bag according to claim 14, wherein:

the outside abuse layer comprises at least one member selected from the group consisting of ethylene/alpha-olefin copolymer having a density of from about 0.85 to 0.95 g/cc, propylene/ethylene copolymer, polyamide, ethylene/vinyl acetate copolymer, ethylene/methyl acrylate copolymer, and ethylene/butyl acrylate copolymer;

the core $0_2$-barrier layer of the first film comprises at least one member selected from the group consisting of ethylene/vinyl alcohol copolymer, polyvinyl chloride, polyvinylidene chloride, polyamide, polyester, and polyacrylonitrile;

the inside-sealant layer of the first film comprises at least one member selected from the group consisting of thermoplastic polyolefin, thermoplastic polyamide, thermoplastic polyester, and thermoplastic polyvinyl chloride; and the second biaxially-oriented, heat-shrinkable film comprises at least one member selected from the group consisting of ethylene/alpha-olefin copolymer having a density of from about 0.85 to 0.95 g/cc, propylene/ethylene copolymer, polyamide, ethylene/vinyl acetate copolymer, ethylene/methyl acrylate copolymer, and ethylene/butyl acrylate copolymer.

16. The patch bag according to claim 8, wherein the bag comprises a first film and the patch comprises a second film, and wherein the backseamed seal is through the first film but not through the second film.

17. The patch bag according to claim 8, wherein the first film is a heat-shrinkable film and the second film is a heat-shrinkable film.

18. The patch bag according to claim 8, wherein the patch has a width of from about 20 to 190 percent, based on the width of the bag.

19. The patch bag according to claim 9, wherein the first side seal is through the first film but not through the second film, and the second side seal is through the first film but not through the second film.

20. The patch bag according to claim 9, wherein the first film is a heat-shrinkable film and the second film is a heat-shrinkable film.

21. The patch bag according to claim 9, wherein the patch has a width of from about 20 to 190 percent, based on the width of the bag.

22. The patch bag according to claim 9, wherein the first film is a biaxially-oriented, heat-shrinkable film comprising an outside abuse layer, a core $0_2$-barrier layer, and an inside-sealant layer, and the second film is a second biaxially-oriented, heat-shrinkable film.

23. The patch bag according to claim 22, wherein:

the outside abuse layer comprises at least one member selected from the group consisting of ethylene/alpha-olefin copolymer having a density of from about 0.85 to 0.95 g/cc, propylene/ethylene copolymer, polyamide, ethylene/vinyl acetate copolymer, ethylene/methyl acrylate copolymer, and ethylene/butyl acrylate copolymer;

the core $0_2$-barrier layer of the first film comprises at least one member selected from the group consisting of ethylene/vinyl alcohol copolymer, polyvinyl chloride, polyvinylidene chloride, polyamide, polyester, and polyacrylonitrile;

the inside-sealant layer of the first film comprises at least one member selected from the group consisting of thermoplastic polyolefin, thermoplastic polyamide, thermoplastic polyester, and thermoplastic polyvinyl chloride; and the second biaxially-oriented, heat-shrinkable film comprises at least one member selected from the group consisting of ethylene/alpha-olefin copolymer having a density of from about 0.85 to 0.95 g/cc, propylene/ethylene copolymer, polyamide, ethylene/vinyl acetate copolymer, ethylene/methyl acrylate copolymer, and ethylene/butyl acrylate copolymer.

24. The patch bag according to claim 2, wherein the first film and the second film each have a total free shrink, at 185° F., of at least 20 percent.

25. The patch bag according to claim 17, wherein the first film and the second film each have a total free shrink, at 185° F., of at least 10 percent.

26. The patch bag according to claim 25, wherein the first film and the second film each have a total free shrink, at 185° F., of at least 20 percent.

27. The patch bag according to claim 20, wherein the first film and the second film each have a total free shrink, at 185° F., of at least 10 percent.

28. The patch bag according to claim 27, wherein the first film and the second film each have a total free shrink, at 185° F., of at least 20 percent.

* * * * *